US008153343B2

(12) United States Patent
Kubo et al.

(10) Patent No.: US 8,153,343 B2
(45) Date of Patent: Apr. 10, 2012

(54) TONER, TWO-COMPONENT DEVELOPER, DEVELOPING DEVICE, AND IMAGE FORMING APPARATUS

(75) Inventors: Masahiko Kubo, Nara (JP); Satoru Ariyoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 582 days.

(21) Appl. No.: 12/344,847

(22) Filed: Dec. 29, 2008

(65) Prior Publication Data

US 2009/0170020 A1 Jul. 2, 2009

(30) Foreign Application Priority Data

Dec. 28, 2007 (JP) ..... P2007-341458

(51) Int. Cl.
*G03G 9/00* (2006.01)

(52) U.S. Cl. ..... 430/108.6; 430/108.4; 430/109.4; 430/123.51

(58) Field of Classification Search ..... 430/109.4, 430/108.4, 108.6, 123.51
See application file for complete search history.

(56) References Cited

U.S. PATENT DOCUMENTS

| | | | | |
|---|---|---|---|---|
| 5,004,664 | A * | 4/1991 | Fuller et al. | 430/109.4 |
| 5,516,825 | A * | 5/1996 | Montador et al. | 524/311 |
| 6,130,020 | A | 10/2000 | Wada et al. | |
| 6,432,600 | B2 | 8/2002 | Suwa et al. | |
| 6,890,695 | B2 | 5/2005 | Shirai et al. | |
| 2003/0147674 | A1 | 8/2003 | Otake et al. | |
| 2003/0157419 | A1 | 8/2003 | Miyakawa et al. | |
| 2004/0234881 | A1 | 11/2004 | Miyakawa et al. | |
| 2005/0196695 | A1 * | 9/2005 | Kubo et al. | 430/108.6 |
| 2006/0115758 | A1 * | 6/2006 | Chang et al. | 430/109.4 |
| 2006/0269858 | A1 * | 11/2006 | McDougall et al. | 430/106.1 |
| 2006/0292473 | A1 * | 12/2006 | Kadokura et al. | 430/108.6 |

FOREIGN PATENT DOCUMENTS

| | | | |
|---|---|---|---|
| CN | 1416028 | A | 5/2003 |
| JP | 4-000452 | | 1/1992 |
| JP | 11-174726 | A | 7/1999 |
| JP | 2001-083731 | | 3/2001 |
| JP | 2001-166537 | | 6/2001 |
| JP | 2002-287426 | | 10/2002 |
| JP | 2002-318471 | A | 10/2002 |
| JP | 2003-107783 | | 4/2003 |
| JP | 2004-053711 | | 2/2004 |
| JP | 2005-17928 | A | 1/2005 |
| JP | 2006-195352 | A | 7/2006 |
| JP | 2006-284614 | A | 10/2006 |
| JP | 2007-140093 | | 6/2007 |
| JP | 2007-197602 | A | 8/2007 |

* cited by examiner

*Primary Examiner* — Thorl Chea
(74) *Attorney, Agent, or Firm* — Nixon & Vanderhye P.C.

(57) ABSTRACT

A toner in which even a toner containing crystalline polyester exhibits excellent fixing property, chargeability, color reproducibility, and long-term stability, as well as a two-component developer, a developing device, and an image forming apparatus are provided. The toner includes toner base particles which contain a colorant and a binder resin containing at least crystalline polyester and an amorphous resin; and a mixed oxide of aluminum oxide and silicon dioxide externally added to the toner base particles, and the toner is so adjusted that the binder resin contains 20% by weight to 50% by weight of the crystalline polyester and that a compositional proportion of aluminum oxide in the mixed oxide of aluminum oxide and silicon dioxide falls within a range of 35% by weight or more and less than 50% by weight.

8 Claims, 2 Drawing Sheets

TONER, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2007-341458, which was filed on Dec. 28, 2007, the contents of which are incorporated herein by reference in its entirety.

BACKGROUND OF THE INVENTION

1. Field of the Invention

The invention relates to a toner, a two-component developer, a developing device, and an image forming apparatus.

2. Description of the Related Art

In recent years, image forming apparatuses employing the electrophotographic process have rapidly been widespread, such as electrostatic copiers or laser beam printers, among which the image forming apparatuses capable of printing in full color are notable.

The image forming apparatus employing the electrophotographic process indicates an apparatus for forming an image on a recording medium such as paper or a sheet through a charging step, an exposure step, a developing step, a transferring step, and a fixing step. In the charging step, a surface of a photoreceptor is evenly charged. In the exposure step, the charge photoreceptor is exposed to light so that an electrostatic latent image is formed on the surface of the photoreceptor. In the developing step, a developer adheres to the electrostatic latent image formed on the surface of the photoreceptor to thereby form a visualized image. In the transferring step, the visualized image formed on the surface of the photoreceptor is transferred to the recording medium. In the fixing step, the visualized image transferred to the recording medium is fixed by heat, pressure, and the like. Through the steps as above, a desired image is formed on the recording medium in the image forming apparatus employing the electrophotographic process.

In a typical image forming apparatus employing the electrophotographic process, full color printing is done with a developer formed of the toners of three colors, i.e., yellow, magenta, and cyan which are three primary colors, or the toners of four colors including black in addition to those three colors. That is to say, the toners of respective colors are all treated in the charging step, the exposure step, the developing step, and the transferring step, to thereby form on the recording medium the visualized image which is composed of the toners of plural colors and which is then fixed onto the recording medium in the fixing step by melting, blending and mixing colors of the toners, thus resulting in a full color image.

With the aim of enhancing the low-temperature fixing property which is one of problems in the fixing step, there have been proposed so far the techniques of using the toner in which a binder resin contains an amorphous resin having a low glass transition temperature, and the toner which contains wax having a low melting temperature. These techniques do not, however, provide sufficient low-temperature fixing property and besides, they have a problem that the preservation stability of the toner deteriorates by the addition of a large amount of the amorphous resin or the wax having a low melting temperature.

Other than the above techniques, the technique of using crystalline polyester having a better low-temperature fixing property as a binder resin has been proposed. This technique has, however, a problem that by using the crystalline polyester alone, the preservation stability, anti-offset property, and the like property deteriorate and thereby narrows the temperature range where the toner can be fixed. And in the case where the crystalline polyester and the amorphous resin are used together, it is difficult for the crystalline polyester to be sufficiently dispersed in the binder resin, and a problem thus arises that favorable charge uniformity is hard to obtain. To deal with the problem, Japanese Unexamined Patent Publication JP-A 2002-287426 discloses an electrophotographic toner which contains the binder resin containing the crystalline polyester and the amorphous resin wherein the crystalline polyester is contained in the binder resin in an amount of from 1% by weight to 40% by weight and wherein 90% or more of a dispersed domain of the crystalline polyester has a diameter of from 0.1 μm to 2 μm, and the dispersibility of the crystalline polyester is thereby adjusted to a proper level so that favorable low-temperature fixing property and charge uniformity are provided.

By the way, various studies have been conducted on an external additive for the purpose of improving the chargeability and flowability of the toner which is one of problems in the developing step and the transferring step. For example, the technique of using conductive fine particles of titanium oxide or the like substance as an external additive for the toner has been proposed in order to stably control a charge amount by moving charges smoothly between toner particles and between the toner and a carrier.

The toner disclosed in Japanese Unexamined Patent Publication JP-A 4-452 (1992) contains titanium oxide treated with a fatty acid metal salt and thereby provides favorable charge stability with a quicker initial rise of charging a newly supplied toner. Further, the dry developer for electrostatic charge image development disclosed in Japanese Unexamined Patent Publication JP-A 2001-83731 contains toner particles containing a binder resin and a colorant, and as a fluidizer (an external additive), amorphous silicon-aluminum co-oxidized fine particles in which $Al_2O_3$ and $SiO_2$ are mixed in predetermined proportion, to thereby prevent the toner particles from being excessively charged so that the charge amount of the toner is maintained at an optimal level for a long period of time.

Moreover, in recent years, numerous efforts have been made in various technical fields from the aspect of environmental conservation. Today, petroleum is used as a raw material of many products, and most of the binder resin which accounts for 70% of constituents of a toner, is also manufactured by using an oil resource as a raw material. To reduce this oil resource use is very important not only from the viewpoint of solving the problem that the oil resource is running out, but also from the viewpoint of prevention of global warming because the amount of carbon dioxide generated in manufacturing or incinerating the oil resource is reduced.

This is why a lot of attention is now given to the use of a plant-derived resource called biomass. Because the carbon dioxide generated in burning the biomass originates from the carbon dioxide which used to exist in the air and has been taken in a plant by photosynthesis, the whole balance of input and output amounts of carbon dioxide in the air is zero, i.e., the total amount of carbon dioxide in the air does not change. Accordingly, if such a plant-derived resource as biomass can be used as a raw material to synthesize a binder resin for toner, the amount of carbon dioxide in the air can be fixed and it would be thus possible to solve the problem of depletion of oil resources and the problem of global warming simultaneously.

For example, the electrophotographic toner disclosed in Japanese Unexamined Patent Publication JP-A 2001-166537 contains as a binder resin a resin which contains a biomass-derived polylactic acid-based biodegradable resin and a terpene phenol copolymer, and exhibits an enhanced low-temperature toner fixing property.

In JP-A 2002-287426, no consideration is given to control of an external additive on a charge amount of the toner containing crystalline polyester with low chargeability, and long-term charge stability of the toner may be therefore decreased.

In JP-A 4-452, titanium oxide which deteriorates transparency of the toner is used and the balance between chargeability and color reproducibility of the toner is not considered, and the color reproducibility may therefore deteriorate in the case of using a color toner which contains crystalline polyester having lower transparency.

In the technique disclosed in JP-A 2001-83731, the toner containing crystalline polyester is not taken into consideration and therefore, in the case of using the toner containing the crystalline polyester with low chargeability, the long-term charge stability may be decreased even with the use of amorphous silicon-aluminum co-oxidized fine particles adjusted to the disclosed mix proportion.

In JP-A 2001-166537, the crystalline polyester, i.e., polylactic acid resin is used, but the dispersibility of the crystalline polyester is not considered, and it therefore may not be possible to obtain a favorable fixing property.

SUMMARY OF THE INVENTION

The invention has been devised in view of the above-described problems and its object is to provide a toner, a two-component developer, a developing device, and an image forming apparatus, in which even a toner containing crystalline polyester exhibits excellent fixing property, chargeability, color reproducibility, and long-term stability.

The invention provides a toner comprising:

toner base particles containing a colorant and a binder resin containing at least crystalline polyester and an amorphous resin; and a mixed oxide of aluminum oxide and silicon dioxide externally added to the toner base particles, wherein a content of the crystalline polyester in the binder resin falls within a range of 20% by weight to 50% by weight, and wherein a compositional proportion of aluminum oxide in the mixed oxide of aluminum oxide and silicon dioxide falls within a range of 35% by weight or more and less than 50% by weight.

According to the invention, in the toner comprising: the toner base particles containing a colorant and a binder resin containing at least crystalline polyester and an amorphous resin; and the mixed oxide of aluminum oxide and silicon dioxide externally added to the toner base particles, a content of the crystalline polyester in the binder resin falls within a range of 20% by weight to 50% by weight. This makes it possible to sufficiently disperse the crystalline polyester having an excellent low-temperature fixing property into the binder resin, therefore resulting in excellent low-temperature fixing property and charge uniformity.

Further, the compositional proportion of the aluminum oxide in the mixed oxide of aluminum oxide and silicon dioxide falls within a range of 35% by weight or more and less than 50% by weight. This allows even the toner of the invention containing the crystalline polyester having low chargeability to maintain an optimal charge amount for a long period of time. And what is more, the toner has better transparency and can exhibit excellent color reproducibility.

Accordingly, the toner of the invention has excellent fixing property, chargeability, and color reproducibility, and is capable of forming high-quality images for a long period of time.

Further, in the invention, it is preferable that the amorphous resin has an acid value of 5 mgKOH/g to 20 mgKOH/g.

According to the invention, the acid value of the amorphous resin is 5 mgKOH/g to 20 mgKOH/g. This allows the toner to further maintain the optimal charge amount and enables formation of high-quality images for a longer period of time.

Further, in the invention, it is preferable that the crystalline polyester contains biomass.

According to the invention, the crystalline polyester contains biomass. This makes it possible to obtain an ecologically friendly toner which can solve the problems of global warming and oil resource depletion.

Further, in the invention, it is preferable that the biomass is a polylactic component.

According to the invention, the biomass is a polylactic component. This makes it easy to control a melting temperature of the toner, and it is thereby possible to obtain a toner having a better fixing property.

Further, in the invention, it is preferable that the mixed oxide of aluminum oxide and silicon dioxide is composed of particles having an average primary particle size of 5 nm to 25 nm.

According to the invention, the mixed oxide of aluminum oxide and silicon dioxide is composed of particles having an average primary particle size of 5 nm to 25 nm. This can provide the toner with more appropriate flowability and chargeability.

Further, in the invention, it is preferable that the mixed oxide of aluminum oxide and silicon dioxide is added in an amount of from 0.1 part by weight to 5.0 parts by weight based on 100 parts by weight of the toner base particles.

According to the invention, the mixed oxide of aluminum oxide and silicon dioxide is added in an amount of from 0.1 part by weight to 5.0 parts by weight based on 100 parts by weight of the toner base particles. This allows the mixed oxide of aluminum oxide and silicon dioxide to exhibit its function sufficiently, thereby making it possible to provide the toner with more appropriate flowability and chargeability, which enables formation of high-quality images for a longer period of time.

Further, in the invention, it is preferable that the mixed oxide of aluminum oxide and silicon dioxide is added in an amount of from 0.1 part by weight to 2.0 parts by weight based on 100 parts by weight of the toner base particles.

According to the invention, the mixed oxide of aluminum oxide and silicon dioxide is added in an amount of from 0.1 part by weight to 2.0 parts by weight based on 100 parts by weight of the toner base particles. This allows the mixed oxide of aluminum oxide and silicon dioxide to exhibit its function more sufficiently, thereby making it possible to provide the toner with yet more appropriate flowability and chargeability, which enables formation of high-quality images for a yet longer period of time.

Further, in the invention, it is preferable that the toner base particles have a volume average particle size of 4.0 μm to 8.0 μm.

According to the invention, it is preferable that the toner base particles have a volume average particle size of 4.0 μm to 8.0 μm. This allows for formation of higher-quality images.

Further, in the invention, it is preferable that the colorant is an organic colorant.

According to the invention, the colorant is an organic colorant. This allows for formation of images which have better color reproducibility.

Further, the invention provides a two-component developer containing the toner mentioned above and a carrier.

According to the invention, the two-component developer of the invention contains the toner mentioned above and a carrier and thereby results in a two-component developer which has excellent fixing property, chargeability, and color reproducibility, and is capable of forming high-quality images for a long period of time.

Further, the invention provides a developing device that performs development with use of the toner mentioned above or the two-component developer mentioned above.

According to the invention, the developing device of the invention carries out development with use of the toner mentioned above or the two-component developer mentioned above, with the result that toner images not causing fogs or uneven image density can be formed on an image carrier over a long period of time.

Further, the invention provides an image forming apparatus having the developing device mentioned above.

According to the invention, the image forming apparatus of the invention has the developing device mentioned above and therefore is capable of forming over a long period of time high-quality images which exhibit excellent color reproducibility without fogs and uneven image density.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
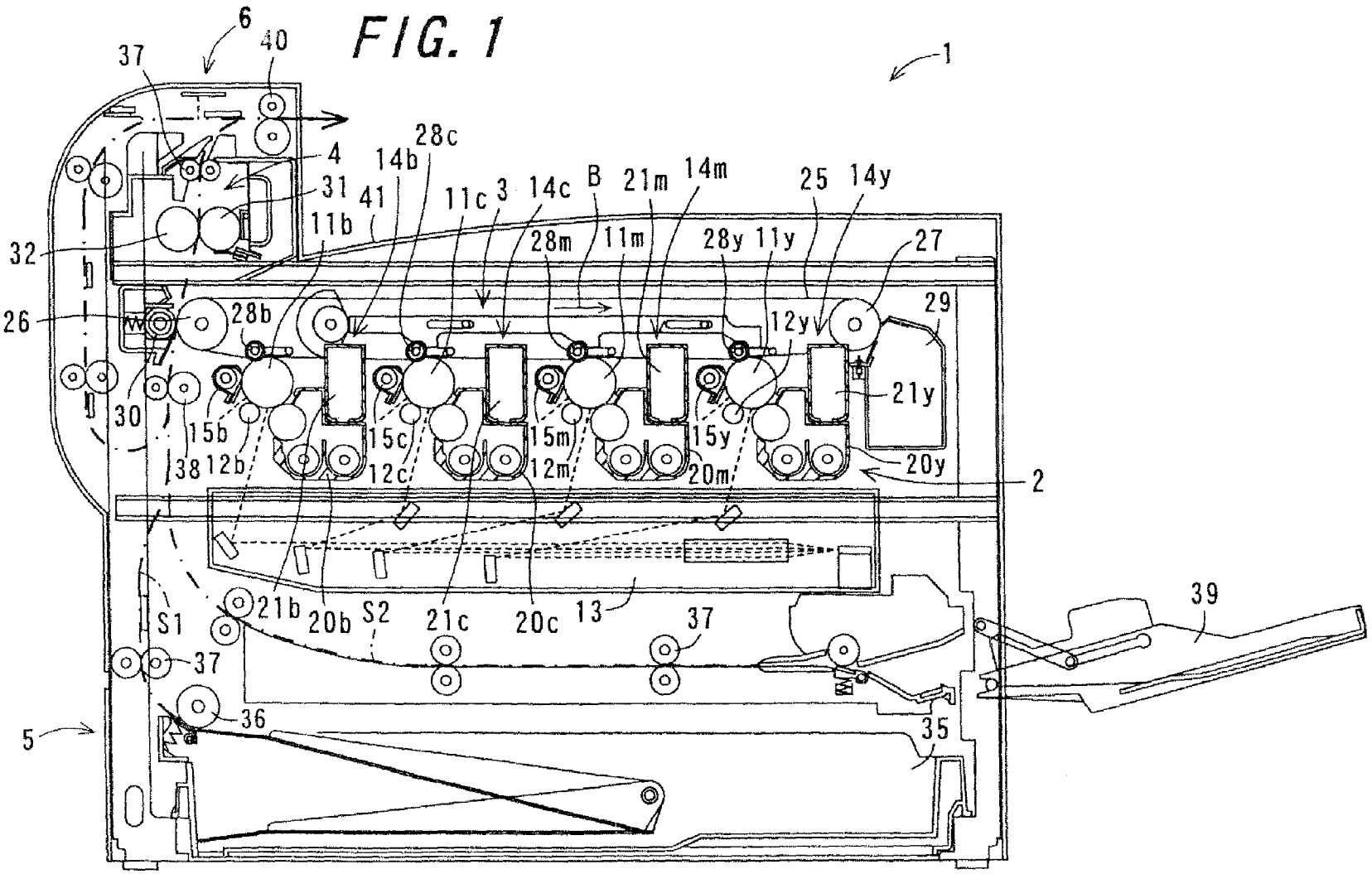
FIG. 1 is a sectional view schematically showing a configuration of an image forming apparatus according to an embodiment of the invention.

Now referring to the drawings, preferred embodiments of the invention are described below.

A toner according to one embodiment of the invention comprises: toner base particles which contain a colorant and a binder resin containing at least crystalline polyester and an amorphous resin; and a mixed oxide of aluminum oxide and silicon dioxide externally added to the toner base particles, and in the toner, a content of the crystalline polyester in the binder resin falls within a range of 20% by weight to 50% by weight, and a compositional proportion of aluminum oxide in the mixed oxide of aluminum oxide and silicon dioxide falls within a range of 35% by weight to 50% by weight, to be specific, 35% by weight or more and less than 50% by weight.

When a content of the crystalline polyester falls within the above range, the crystalline polyester having an excellent low-temperature fixing property can be sufficiently dispersed into the binder resin, therefore allowing for excellent low-temperature fixing property and charge uniformity.

Further, when a compositional proportion of the aluminum oxide falls within the above range, even the toner according to the present embodiment containing the crystalline polyester having low chargeability can maintain its optimal charge amount over a long period of time. Moreover, the toner will have favorable transparency and therefore be able to exhibit excellent color reproducibility.

Accordingly, the toner according to the embodiment has excellent fixing property, chargeability, and color reproducibility and is therefore capable of forming high-quality images over a long period of time.

Hereinafter, the toner according to the embodiment will be described. The toner according to the embodiment is formed by adding an external additive to the toner base particles.

[Toner Base Particles]

The toner base particles contain a binder resin and a colorant. The toner base particles may contain other toner additive components such as a charge control agent and a release agent in addition to the binder resin and the colorant.

The toner base particles preferably have a volume average particle size of 4.0 μm to 8.0 μm. This enables formation of higher-quality images. The volume average particle size less than 4.0 μm leads to too small a charge amount per one particle of the toner which may therefore not be able to form favorable images. And the toner particles having the volume average particle size more than 8.0 μm are too large to form high-definition images and may thus deteriorate thin-line reproducibility. Now, the volume average particle size indicates a particle size $D_{50v}$ at 50% in accumulated volume counted from a large particle-side in an accumulated volume distribution.

Hereinafter, respective raw materials constituting the toner base particles will be described.

(a) Binder Resin

The binder resin contains at least crystalline polyester and an amorphous resin. In the toner according to the present embodiment, a content of the crystalline polyester in the binder resin falls within a range of 20% by weight to 50% by weight. This makes it possible to sufficiently disperse the crystalline polyester having an excellent low-temperature fixing property into the binder resin, therefore allowing for excellent low-temperature fixing property and charge uniformity. The content of the crystalline polyester less than 20% by weight will cause a failure to obtain a favorable low-temperature fixing property. And the content of the crystalline polyester more than 50% by weight will cause the crystalline polyester to fail to be sufficiently dispersed into the binder resin and thus leads to deterioration of charge uniformity which will cause fogs or the like troubles and thus make it impossible to form favorable images. And also, the toner will have decreased transparency.

The crystalline polyester is not particularly limited and may be, for example, formed by polycondensation of an alcohol component of divalent or higher polyvalent alcohol and a carboxylic component of divalent or higher polyvalent carboxylic component. To be specific, the following ingredients can be used preferably.

From the aspect of a softening temperature and crystallization of the crystalline polyester, diol having a carbon number of 2 to 6 is used for the alcohol component, and fumaric acid or terephthalic aid is used for the carboxylic component.

The diol having a carbon number of 2 to 6 includes 1,3-propanediol, 1,4-butanediol, ethylene glycol, 1,2-propylene glycol, 1,3-propylene glycol, 1,6-hexanediol, neopentyl glycol, 1,4-butanediol, and 1,5-pentanediol, among which α, ω-linear alkylene glycol is preferable and 1,4-butanediol is more preferable.

The divalent alcohol which may be contained, other than the diol having a carbon number of 2 to 6, in the alcohol component includes diethylene glycol, triethyleneglycol, 1,8-octanediol, 1,4-cyclohexanedimethanol, dipropyleneglycol, polyethyleneglycol, polypropyleneglycol, polytetramethylene glycol, and hydrogenated bisphenol A, among which are preferred aliphatic diol having a carbon number of 7 to 20, condensation products thereof, and condensation products of diol having a carbon number of 2 to 6.

The trivalent or higher-valent alcohol includes sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trihydroxymethylbenzene, among which glycerin is preferred from the aspect of the softening temperature and crystallization of the crystalline polyester.

Other than fumaric acid, a preferable divalent carboxylic compound which may be contained in the carboxylic component includes maleic acid, citraconic acid, itaconic acid, glutaconic acid, phthalic acid, isophthalic acid, terephthalic acid, cyclohexanedicarboxlic acid, succinic acid, adipic acid, sebacic acid, azelaic acid, malonic acid, succinic acid such as dodecenyl succinic acid or dodecyl succinic acid, which is substituted by an alkyl group having a carbon number of 1 to 20 or an alkenyl group having a carbon number of 2 to 20, and acid anhydrides of those listed, as well as a derivative of alkyl (having a carbon umber of 1 to 3) ester or the like substance.

The trivalent or higher-valent carboxylic compound includes 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, enpol trimer acid, and anhydrides of those listed, as well as a derivative of alkyl (having a carbon number of 1 to 3) ester or the like substance, among which trimellitic acid and derivatives thereof are preferable from the aspect of the softening temperature and crystallization of the crystalline polyester.

Further, the crystalline polyester preferably contains biomass. This makes it possible to obtain an ecologically friendly toner which can solve the problems of global warming and oil resource depletion. The biomass herein indicates a plant-derived resource which becomes a copolymer component of the crystalline polyester.

A content of the biomass in the crystalline polyester preferably falls within a range of 60 mol % to 100 mol %.

The biomass-containing crystalline polyester includes a polylactic resin (PLA), polybutylene succinate (PBS), polyhydroxyalkanoate (PHA), and a resin containing as a copolymer component a basic structure of these resins listed above, among which is preferred a resin (copolymer) containing the polylactic resin and the polylactic component as biomass. The polylactic component herein indicates a copolymer component of the crystalline polyester having a basic structure of the polylactic resin. Such biomass of a polylactic component makes it easy to control a melting temperature of the toner and is thereby able to result in a toner having a better fixing property.

In the resin containing the polylactic component, the contents of L-form and D-form are not particularly limited and may be selected appropriately. The L-form and the D-form herein indicate optical isomers having different configurations, which are denoted in the DL notation based on IUPAC nomenclature system. The DL notation is a nomenclature system according to which, on the basis of the configuration of d-glyceraldehyde, a compound formed without breaking the configuration is called a D-form while its enantiomer is called an L-form.

A process for producing the crystalline polyester is not particularly limited and a heretofore known process may be employed. For example, there is a process of polycondensation of desired alcohol component and carboxylic component with use of heretofore known polymerization catalyst or polymerization inhibitor. Further, a process for producing the biomass-containing crystalline polyester, i.e., the polylactic resin, includes: a process of heating and depressurizing to induce a dehydration polycondensation reaction directly of a lactic acid monomer, i.e., L-lactic acid or D-lactic acid; a process of heating ring-opening polymerization with use of a heretofore known polymerization catalyst such as L-lactide, D-lactide, meso-lactide, or DL-lactide that is a cyclic dimer of lactic acid; and a process of transesterification reaction. Moreover, a process for producing polyhydroxyalkanoate (PHA) includes a process disclosed by Japanese Unexamined Patent Publication JP-A 2003-12909. Furthermore, a process for producing the resin (copolymer) containing the polylactic component includes a process of polymerization, with use of a heretofore known polymerization catalyst, of alcohol component and carboxylic component added to the polylactic resin produced as above.

The polymerization catalyst used in the above polymerization reactions is not particularly limited and may be a heretofore known catalyst for polymerization. The polymerization catalyst includes, for example, a tin-based compound such as tin octylate, tin lactate, tin tartrate, tin dicaprylate, tin dilaurate, tin dipalmitate, tin distearate, tin dioleate, tin α-naphthoate, or tin β-naphthoate; tin powder and tin oxide; zinc dust, halogenated zinc, zinc oxide, and an organozinc-based compound; a titanium-based compound such as tetrapropyl titanate; a zirconium-based compound such as zirconium isopropoxide; an antimony-based compound such as antimony trioxide; a bismuth-based compound such as bismuth oxide (III); and an aluminum-based compound such as aluminum oxide or aluminum isopropoxide. A usage of the catalyst is not particularly limited and for example is of the order of 0.001% by weight to 5% by weight based on lactide in the case where the ring-opening polymerization is carried out. The polymerization reaction may be carried out under the presence of the above-stated polymerization catalyst, typically at a temperature of 100° C. to 220° C. which varies depending on a kind of the catalyst.

A molecular weight of the binder resin is not particularly limited and may be appropriately selected from a wide range. The weight average molecular weight (Mw) is preferably 5,000 or more and 500,000 or less. The binder resin having the weight average molecular weight (Mw) less than 5,000 has decreased mechanical strength and results in the toner which is easily pulverized, for example, by agitation inside the developing device and of which particle shapes will change and possibly cause fluctuation in chargeability. The binder resin having the weight average molecular weight (Mw) more than 500,000 is less easily molten, therefore making it difficult to knead the toner ingredients in the melt-kneading process and possibly leading to a decrease in the dispersibility of the colorant, release agent, and charge control agent in the melt-kneaded materials. Further, a fixing property of the toner to the recording medium may decrease and thus cause a fixing failure. Note that the weight average molecular weight (Mw) and the number average molecular weight (Mn) are polystyrene equivalencies measured by use of gel permeation chromatography (abbreviated as GPC).

A softening temperature ($T_{1/2}$) of the crystalline polyester may be appropriately selected from a wide range without particular limitation and preferably falls within a range of 60° C. or more and 150° C. or less. The crystalline polyester having a softening temperature ($T_{1/2}$) less than 60° C. may decrease the preservation stability of the toner and increasingly cause the thermal aggregation of the toner inside the image forming apparatus, causing a failure to stably supply the toner to an image bearing member and thus causing a development failure. Further, malfunction of the image forming apparatus may be induced. The crystalline polyester having a softening temperature ($T_{1/2}$) exceeding 150° C. is less easily molten in the melt-kneading process, therefore making it difficult to knead the respective ingredients of the toner base particles and possibly leading to a decrease in the dispersibility of the colorant, release agent, and charge control agent in the melt-kneaded materials. Furthermore, the toner becomes less easily molten or softened when being fixed to a recording medium and therefore, a fixing property of the toner to the recording medium may decrease and thus cause a fixing failure.

An acid value of the crystalline polyester may be appropriately selected from a wide range without particular limitation and preferably falls within a range of 1 mgKOH/g or more and 30 mgKOH/g or less. The acid value herein is a value measured in accordance with a neutralization titration method.

The amorphous resin is not particularly limited and may be a heretofore known binder resin for toner, including, for example, a polyester-based resin; a styrene-based resin such as polystyrene or styrene-acrylic ester copolymer resin; an acryl-based resin such as polymethylmethacrylate; a polyolefin-based resin such as polyethylene; a polyurethane resin; and an epoxy resin, among which the polyester-based resin is preferred. Also usable is a resin obtained by polymerization reaction of an ingredient monomer mixture and the release agent which are mixed with each other.

The acid value of the amorphous resin preferably falls within a range of 5 mgKOH/g to 20 mgKOH/g. This allows the toner to further maintain the optimal charge amount and enables formation of high-quality images over a longer period of time.

The amorphous resin having the acid value less than 5 mgKOH/g results in a toner having so low chargeability that the toner charge amount cannot be maintained at a sufficient level even with a higher compositional proportion of silicon dioxide, and may thus decrease an average charge amount and thereby lead to Uneven image density and cause fogs.

The amorphous resin having the acid value more than 20 mgKOH/g results in a toner having so high chargeability that the toner surface resistance cannot be maintained at an optimal level even with a higher compositional proportion of aluminum oxide, and may thus increase the toner charge amount and thereby lead to a decrease in image density and cause fogs.

(b) Colorant

A specific example of the colorant includes an yellow toner colorant, a magenta toner colorant, a cyan toner colorant, and a black toner colorant. Hereinbelow, the color index will be abbreviated as "C.I."

The yellow toner colorant includes, for example: a pigment such as C.I. pigment yellow 1, C.I. pigment yellow 5, C.I. pigment yellow 12, C.I. pigment yellow 15, C.I. pigment yellow 17, C.I. pigment yellow 180, C.I. pigment yellow 93, C.I. pigment yellow 74, or C.I. pigment yellow 185; an inorganic pigment such as yellow iron oxide or yellow ocher; nitro dye such as C.I. acid yellow 1; and oil-soluble dye such as C.I. solvent yellow 2, C.I. solvent yellow 6, C.I. solvent yellow 14, C.I. solvent yellow 15, C.I. solvent yellow 19, or C.I. solvent yellow 21, which are all classified according to the color index.

The magenta toner colorant includes, for example, C.I. pigment red 49, C.I. pigment red 57, C.I. pigment red 81, C.I. pigment red 122, C.I. solvent red 19, C.I. solvent red 49, C.I. solvent red 52, C.I. basic red 10, and C.I. disperse red 15, which are all classified according to the color index.

The cyan toner colorant includes, for example, C.I. pigment blue 15, C.I. pigment blue 16, C.I. solvent blue 55, C.I. solvent blue 70, C.I. direct blue 25, and C.I. direct blue 86.

The black toner colorant includes, for example, carbon black such as channel black, roller black, disk black, gas furnace black, oil furnace black, thermal black, and acetylene black. Among these carbon black, suitable carbon black may be appropriately selected according to design characteristics of the toner to be obtained.

Other than these pigments, a purple pigment, a green pigment, and the like may be used. The colorants may be used each alone, or two or more thereof may be used in combination. Further, two or more of the colorants of the same color series may be used together, and one or two or more colorants respectively selected from different color series may also be used together.

The colorant is preferably used in form of a master batch. The master batch of the colorant can be produced by kneading a molten product of synthetic resin and the colorant. For the synthetic resin, a resin is used of the same sort as the amorphous resin contained in the binder resin of the toner, or used is a resin highly compatible with the amorphous resin. A proportion of the synthetic resin and the colorant is not particularly limited, and it is preferable that the colorant constitute 30 parts by weight or more and 100 parts by weight or less based on 100 parts of the synthetic resin. The master batch is used, for example, with granulated particles around 2 mm to 3 mm in size.

A content of the colorant in the toner base particles of the invention is not particularly limited, and preferably falls within a range of 2 parts by weight or more and 20 parts by weight or less based on 100 parts by weight of the binder resin. In the case of using the master batch, a usage of the master batch is preferably adjusted so that a content of the colorant in the toner base particles of the invention falls within the above range. When the content of the colorant falls within the above range, it is possible to form a favorable image having excellent image quality with sufficient image density and high color appearance. The content of the colorant less than 2 parts by weight may lead to a failure to reach desired image density. And the content of the colorant more than 20 parts by weight may result in too high image density and thus have a narrower range of color reproduction.

A preferable colorant among the above-listed examples is an organic colorant. This allows for more prominent expression of the effect produced by favorable transparency and thus makes it possible to form images with higher color reproducibility, particularly in the case where the toner of the invention is a color toner.

(c) Charge Control Agent

The usable charge control agent includes a positive charge control agent and a negative charge control agent. The positive charge control agent includes, for example, a basic dye, quaternary ammonium salt, quaternary phosphonium salt, aminopyrine, a pyrimidine compound, a polynuclear polyamino compound, aminosilane, a triphenylmethane derivative, guanidine salt, and amidine salt. The negative charge control agent includes a metal-containing azo compound, an azo complex dye, metal salt naphthenate, salicylic acid, metal complex and metal salt (the metal includes chrome, zinc, and zirconium) of a salicylic acid derivative, a boron compound, a fatty acid soap, long-chain alkylcarboxylic acid salt, and a resin acid soap. The charge control agents may be used each alone, or two or more thereof may be used in combination. By adding the charge control agent to a toner, it is possible to provide the toner with favorable chargeability.

The usage of the charge control agent is not particularly limited, and preferably falls within a range of 0.5 part by weight or more and 5 parts by weight or less based on 100 parts by weight of the binder resin, more preferably 0.5 part by weight or more and 3 parts by weight or less based on 100 parts by weight of the binder resin. When the content of the charge control agent is larger than 5 parts by weight, a carrier may be contaminated, which causes the toner to spatter. When the content of the non-compatible charge control agent is less than 0.5 part by weight, the toner may not be given sufficient chargeability.

Note that for use in the color toner, a colorless charge control agent is desirable and for example, salicylic acid is desirable and so are metal complex and metal salt of a salicylic acid derivative.

(d) Release Agent

The release agent is not particularly limited and a heretofore known release agent may be used including a low-polar release agent represented by: petroleum-based wax such as paraffin wax, a derivative thereof, microcrystalline wax or a derivative thereof; and hydrocarbon-based synthetic wax such as Fischer-Tropsch wax, a derivative thereof, polyolefin wax, a derivative thereof, low-molecular-weight polypropylene wax, a derivative thereof, polyolefinic polymer wax, or a derivative thereof, and a highly-polar release agent represented by carnauba wax, a derivative thereof, or ester-based wax. The release agents may be used each alone, or two or more thereof may be used in combination.

The release agent is added to a toner in fixing the toner to a recording medium, for the purpose of providing the toner with a releasing property. That is why the toner can achieve an increase in a hot-offset-start temperature and improvement of an anti-offset property as compared to a toner containing no release agent. Furthermore, the release agent is molten by heat for fixing the toner so that a fixing-start temperature is lowered, thereby allowing for improvement of the low-temperature fixing property.

The usage of the release agent may be appropriately selected from a wide range without particular limitation and preferably falls within a range of 0.2 part by weight to 20 parts by weight based on 100 parts by weight of the binder resin. With the release agent of more than 20 parts by weight, the toner-filming on a photoreceptor surface and the spent to carrier may be more likely to occur. And the usage of the release agent less than 0.2 part by weight may not be enough to exhibit the function of the release agent.

(Process for Producing Toner Base Particles)

The process for producing the toner base particles of the present embodiment is not particularly limited and may be a heretofore known production process including, for example, a melt-kneading and pulverizing process. According to the melt-kneading and pulverizing process, predetermined amounts of the binder resin, the colorant and the other additive components such as the releasing agent and the charge control agent are firstly dry-mixed by a mixer into a mixture. The mixture thus obtained is then melt-kneaded by a kneading machine into melt-kneaded materials which are thereafter cooled to room temperature and thus result in a solidified product. And the solidified product thus obtained is then mechanically pulverized into a pulverized product which is further classified by a classifier to remove excessively pulverized parts and coarse particles. The toner base particles of the present embodiment can be thus produced.

As the mixer used for dry-mixing the toner ingredients, a heretofore known mixer may be used including, for example, a Henschel-type mixing device such as HENSCHELMIXER (trade name) manufactured by Mitsui Mining Co., Ltd., SUPERMIXER (trade name) manufactured by Kawata MFG Co., Ltd., or MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

The melt-kneading process is carried out by agitation under heat at a melting temperature (which is typically around 80° C. to 200° C., preferably around 100° C. to 150° C.) of the binder resin or higher temperature. The kneading machine used for the melt-kneading process may be a heretofore known commonly-used kneading machine including, for example, a twin-screw extruder, a three roll mill, and a laboplast mill. Furthermore, specific examples of such a kneading machine include single or twin screw extruders such as TEM-100B (trade name) manufactured by Toshiba Machine Co., Ltd. or PCM-65/87 (trade name) manufactured by Ikegai, Ltd., and open roll-type kneading machines such as KNEADEX (trade name) manufactured by Mitsui Mining Co., Ltd. Among these kneaders, an open roll-type kneading machine is preferred in view of its advantage that the dispersibility of respective raw materials is enhanced more.

For the mechanical pulverization of the solidified product of the melt-kneaded materials, it is possible to use a cutter mill, a feather mill, a jet mill, or the like device, to which a usable device is not particularly limited. For example, the solidified product of melt-kneaded materials is coarsely pulverized by the cutter mill and then finely pulverized by the jet mill so that the toner base particles having desired volume average particle size can be obtained.

For the classification of the pulverized product, a heretofore known classifier is usable by which the excessively pulverized parts and the coarse particles can be removed through the classification using centrifugal force or wind force. The heretofore known classifier includes, for example, a swivel pneumatic classifier (rotary pneumatic classifier).

Next, another process for producing the toner base particles of the embodiment will be explained. According to the other production process, the coarsely pulverized particles obtained by coarsely pulverizing the solidified product of melt-kneaded materials prepared in the same manner as above are finely dispersed into an aqueous medium, thus forming aqueous slurry. Subsequently, the aqueous slurry obtained is treated by a high-pressure homogenizer so that the coarsely pulverized particles become fine particles. And the fine particles thus obtained are heated in the aqueous medium to be aggregated/molten. The toner base particles of the embodiment can be thus produced.

For the coarse pulverization of the solidified product of the melt-kneaded materials, a jet mill or a hand mill may be used, for example. This allows the coarsely pulverized particles to have particle sizes of around 100 μm to 3 mm.

In preparing the aqueous slurry, an adequate amount of a dispersant such as sodium dodecylbenzenesulfonate has been dispersed in the aqueous medium in advance, for example, and resultant aqueous slurry will thereby have the coarsely pulverized parts finely dispersed therein.

For formation of the fine particles from the coarsely pulverized parts, a commercially-available high-pressure homogenizer may be used. The high-pressure homogenizer available on the market includes, for example: chamber-type high-pressure homogenizers such as MICOFLUIDIZER (trade name) manufactured by Microfluidics Corporation, NANOMIZER (trade name) manufactured by Nanomizer Inc., and ULTIMIZER (trade name) manufactured by Sugino Machine Ltd.; HIGH-PRESSURE HOMOGENIZER (trade name) manufactured by Rannie Inc.; HIGH-PRESSURE HOMOGENIZER (trade name) manufactured by Sanmaru Machinery Co., Ltd.; HIGH-PRESSURE HOMOGENIZER (trade name) manufactured by Izumi Food Machinery Co., Ltd; and NANO3000 (trade name) manufactured by Beryu Co., Ltd. By using one of these high-pressure homogenizers, the aqueous slurry is treated to have fine particles of which volume average particle size is around 0.4 μm to 1.0 μm.

The aqueous slurry is heated to aggregate and further melt the fine particles so that particle associations are formed, thereby resulting in the toner base particles having desired volume average particle size and average degree of circularity. The volume average particle size and the average degree of circularity can be set at desired level, for example, by appropriately selecting heating temperature and heating duration for the aqueous slurry containing fine particles. The heating temperature is appropriately selected from a temperature range of the softening temperature of the binder resin or higher and lower than the decomposition temperature of the binder resin. Under the same heating-duration condition, higher heating temperature usually results in a larger volume average particle size of the toner base particles.

The toner base particles produced as above may be wholly or partially subjected to the spheronization process. A device for the spheronization process includes an impact-type spheronizing device and a hot-air-type spheronizing device. A usable example of the impact-type spheronizing device is a commercially-available device including FACULTY (trade name) manufactured by Hosokawa Micron Corporation and HYBRIDIZATION SYSTEM (trade name) manufactured by Nara Machinery Co., Ltd. And a usable example of the hot-air-type spheronizing device is a commercially-available device including a surface modifying system: METEO-RAINBOW (trade name) manufactured by Nippon Pneumatic MFG. Co., Ltd.

[External Additive]

With the toner base particles produced as above, an external additive may be mixed having functions such as enhancing powder flowability, enhancing frictional chargeability, enhancing heat resistance, improving long-term preservation stability, improving a cleaning property, and controlling a wear characteristic of photoreceptor surface. In the present embodiment, the external additive contains a mixed oxide of aluminum oxide and silicon dioxide as an essential component.

(Mixed Oxide of Aluminum Oxide and Silicon Dioxide)

The external additive contains a mixed oxide of aluminum oxide and silicon dioxide. The silicon dioxide contained in the mixed oxide of aluminum oxide and silicon dioxide has functions of making the toner flowability better and further enhancing the toner surface resistance to thereby decrease the toner charge amount. On the other hand, the aluminum oxide has a function of lowering the toner surface resistance to thereby increase the toner charge amount. Accordingly, the external addition of the mixed oxide of aluminum oxide and silicon dioxide allows for control of the chargeability and flowability of the toner. Moreover, the toner can be more transparent and exhibit excellent color reproducibility owing to the external addition of the mixed oxide of aluminum oxide and silicon dioxide.

And a compositional proportion of aluminum oxide in the mixed oxide of aluminum oxide and silicon dioxide falls within a range of 35% by weight to 50% by weight, to be specific, 35% by weight or more and less than 50% by weight. This allows even the toner of the embodiment containing crystalline polyester having low chargeability to maintain an optimal charge amount over a long period of time. The compositional proportion of aluminum oxide lower than 35% by weight is not enough to adjust to an optimal level a charge amount of the toner of the embodiment containing crystalline polyester having low chargeability, and thereby broadens the charge amount distribution, which leads to a decrease in image density as well as to generation of fogs. And the compositional proportion of aluminum oxide exceeding 50% by weight means too low a compositional proportion of silicon dioxide, which decreases the average toner charge amount and generates uneven image density and fogs. Note that the compositional proportion of aluminum oxide is a value determined by fluorescent X-ray analysis on the toner.

The mixed oxide of aluminum oxide and silicon dioxide may be produced in a dry process or in a wet process. A preferred example of the process for producing the mixed oxide of aluminum oxide and silicon dioxide is a flame-hydrolysis process disclosed in Japanese Unexamined Patent Publication JP-A 6-199516 (1994), for example. In the flame-hydrolysis process, the mixed oxide of aluminum oxide and silicon dioxide can be produced by conjointly oxidizing aluminum chloride and silicon halide in the vapor phase in a flame. In this case, by modifying the proportion of aluminum oxide and silicon dioxide to be supplied, it is possible to produce the mixed oxide of aluminum oxide and silicon dioxide which contains aluminum oxide and silicon dioxide in any proportion. Moreover, a change in the proportion of aluminum oxide to silicon dioxide contained in the mixed oxide of aluminum oxide and silicon dioxide allows for a control of its particle size.

The mixed oxide of aluminum oxide and silicon dioxide preferably has an average primary particle size of 5 nm to 25 nm. Such the oxide can provide the toner with more adequate flowability and chargeability. If the mixed oxide of aluminum oxide and silicon dioxide has an average primary particle size smaller than 5 nm, a larger amount of aggregates of the mixed oxide of aluminum oxide and silicon dioxide will adhere to the toner and thus, the mixed oxide of aluminum oxide and silicon dioxide will be attached unevenly to the toner which will therefore have deteriorated flowability and furthermore exhibit uneven surface resistance. This may result in a failure to obtain uniform toner supply property and chargeability, which may deteriorate images. And if the mixed oxide of aluminum oxide and silicon dioxide has an average primary particle size larger than 25 nm, it may not be possible to adjust surface resistance of a resultant toner to an adequate level.

The above-stated average primary particle size can be measured by using a particle size distribution measurement device such as a scanning electron microscope (SEM), a transmission electron microscope (TEM), or DLS-800 manufactured by Otsuka electronics Co., Ltd., and COULTER-N4 manufactured by Coulter Electronics, Inc. which make use of dynamic light scattering. Among these measurement devices, the scanning electron microscope (SEM) or the transmission electron microscope (TEM) is preferably used to form photo images which are then analyzed to directly determine an average primary particle size, in view of the difficulty in dissociating secondary aggregates of particles after hydrophobizing treatment.

An amount of the mixed oxide of aluminum oxide and silicon dioxide to be added preferably falls within a range of 0.1 part by weight to 5.0 parts by weight, more preferably 0.1 part by weight to 2.0 parts by weight based on 100 parts by weight of the toner base particles. This amount allows the mixed oxide of aluminum oxide and silicon dioxide to exhibit its function sufficiently, thereby making it possible to provide the toner with more appropriate flowability and chargeability, which enables formation of high-quality images. If the mixed oxide of aluminum oxide and silicon dioxide is added in an amount of less than 0.1 part by weight, the toner may not be able to secure its adequate flowability and may fail to adjust its surface resistance to an adequate level. And if the mixed oxide of aluminum oxide and silicon dioxide is added in an amount of more than 2.0 parts by weight, the mixed oxide of aluminum oxide and silicon dioxide may become more unlikely to adhere to the toner base particles.

(Other Inorganic Fine Powder)

For the external additive, inorganic fine powders other than the mixed oxide of aluminum oxide and silicon dioxide may be used in combination. The other inorganic fine powders may be those commonly-used in the relevant filed, and a preferable example thereof includes silica fine powders that are capable of controlling the flowability and do not affect the transparency of the toner. The inorganic fine powders may be used alone, or two or more thereof may be used in combination.

An additive amount of the other inorganic fine powders preferably falls within a range of 0.1 part by weight or more and 10 parts by weight or less, more preferably 2.0 parts by weight or more and less than 4.0 parts by weight based on 100 parts by weight of the toner base particles, in view of the charge amount required for the toner, the influence of the external additive on the photoreceptor wear, the environmental characteristics of the toner, or the like factor. And primary particles of the other inorganic fine powders have a number average particle size of preferably 10 nm to 500 nm, particularly preferably 50 nm. A use of the inorganic fine powders having such particle sizes allows the toner to more prominently exhibit its flowability-enhancing effect.

The mixed oxide of aluminum oxide and silicon dioxide and the other inorganic fine powders are preferably treated with silicone varnish, various modified silicone varnish, silicone oil, various modified silicone oil, a silane coupling agent, a functional silane coupling agent, other organic silicon compound, or the like treatment agent. Especially, it is preferable to use hexamethyldisilazane (HMDS) for surface treatment of the mixed oxide of aluminum oxide and silicon dioxide and the other inorganic fine powders.

The external additive is externally added by mixing the toner base particles with a predetermined amount of the external additive in a mixer. The mixer may be a heretofore known mixer including, for example, HENSCHELMIXER (trade name) manufactured by Mitsui Mining Co., Ltd. and SUPERMIXER (trade name) manufactured by Kawata MFG Co., Ltd.

The toner of the embodiment produced as above may be used as one-component developer without change and may also be mixed with a carrier to be used in form of two-component developer.

For the carrier, magnetic particles may be used. Specific examples of the magnetic particles include a metal such as iron, ferrite, or magnetite; and an alloy composed of the metal just cited and another metal such as aluminum or lead. Among these examples, ferrite is preferred.

Further, the carrier may be a resin-coated carrier in which the magnetic particles are coated with a resin, or a dispersed-in-resin carrier in which the magnetic particles are dispersed in a resin. The resin for coating the magnetic particles is not particularly limited and includes, for example, olefin-based resin, styrene-based resin, styrene-acrylic resin, silicone-based resin, ester-based resin, and fluorine-containing polymer-based resin. The resin used for the dispersed-in-resin carrier is not particularly limited either and includes, for example, styrene-acrylic resin, polyester-based resin, fluorine-based resin, and phenol-based resin.

A shape of the carrier particle is preferably spherical or oblong. Further, a volume average particle size of the carrier is not particularly limited, and in consideration of enhancement in image quality, it preferably falls within a range of 10 μm to 100 μm, more preferably 20 μm to 50 μm. The carrier particles having a volume average particle size of 20 μm to 50 μm allow the toner particles to make contact therewith more frequently and moreover allow each toner particle to have a properly controlled charge amount, which makes it possible to form high-quality images without no-image parts or fogs.

Furthermore, resistivity of the carrier is preferably $10^8$ Ω·cm or more, more preferably $10^{12}$ Ω·cm or more. The carrier's resistivity is obtained as follows. The carrier particles are put in a vessel having a cross-sectional area of 0.50 $cm^2$ and crammed in the vessel by tapping and then, a load of 1 $kg/cm^2$ is imposed on the carrier particles in the vessel while a voltage is applied between the load and a bottom electrode to generate an electric field of 1,000 V/cm there. In the situation just described, a current value is read from which the carrier's resistivity is derived. The low resistivity will cause charge injection into a carrier when a bias voltage is applied to the developing sleeve (developing roller), and this makes the carrier particles become more likely to adhere to a photoreceptor. In addition, this induces breakdown of the bias voltage more frequently.

Magnetization intensity (maximum magnetization) of the carrier preferably falls within a range of 10 emu/g to 60 emu/g, more preferably 15 emu/g to 40 emu/g. The magnetization intensity depends on magnetic flux density of the developing roller. Under a condition that the developing roller has normal magnetic flux density, the magnetization intensity less than 10 emu/g will lead to a failure to exercise magnetic binding force, which may cause the carrier to be splattered. When the magnetization intensity exceeds 60 emu/g, it becomes difficult to keep a noncontact state with the image bearing member in a noncontact development where brush of the carrier is too high, and in a contact development, sweeping patterns may appear more frequently in a toner image.

A proportion of the toner to the carrier contained in the two-component developer is not particularly limited and may be appropriately selected according to kinds of the toner and the carrier. To take the case of the resin-coated carrier (having density of 5 $g/cm^2$ to 8 $g/cm^2$) as an example, it is preferable to use the toner in such an amount that the content of the toner in the two-component developer falls within a range of 2% by weight to 30% by weight, preferably 2% by weight to 20% by weight based on a total amount of the two-component developer. And in the two-component developer, the coverage of the toner over the carrier preferably falls within a range of 40% to 80%.

The two-component developer according to the embodiment of the invention contains the carrier and the toner according to the embodiment and thereby exhibits excellent fixing property, chargeability, and color reproducibility, thus allowing for formation of high-quality images over a long period of time.

[Image Forming Apparatus]

FIG. 1 is a sectional view schematically showing a configuration of an image forming apparatus 1 according to an embodiment of the invention. The image forming apparatus 1 is a multifunctional peripheral having a copier function, a printer function, and a facsimile function together, and according to image information being conveyed to the image forming apparatus 1, a full-color or monochrome image is formed on a recording medium. That is, the image forming apparatus 1 has three types of print mode, i.e., a copier mode, a printer mode and a FAX mode, and the print mode is selected by a control unit (not shown) in accordance with, for example, the operation input from an operation portion (not shown) and reception of the printing job from a personal computer, a mobile device, an information recording storage medium, and an external equipment using a memory device. The image forming apparatus 1 includes a toner image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. The four sets of respective components provided for the respective colors are distinguished herein by giving alphabets indicating the respective colors to the end of the reference numerals, and in the case where the sets are collectively referred to, only the reference numerals are shown.

The toner image forming section 2 includes a photoreceptor drum 11, a charging section 12, an exposure unit 13, a developing device 14, and a cleaning unit 15. The charging section 12, the developing device 14, and the cleaning unit 15 are disposed around the photoreceptor drum 11 in the order just stated. The charging section 12 is disposed vertically below the developing section 14 and the cleaning unit 15.

The photoreceptor drum 11 is rotatably supported around an axis thereof by a drive portion (not shown) and includes a conductive substrate (not shown) and a photosensitive layer (not shown) formed on a surface of the conductive substrate. The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field may be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing at least conductive particles or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the charging property of the photosensitive layer can be enhanced under at least either a low temperature circumstance or a low humidity circumstance. Further, the photosensitive layer may be a laminated photoreceptor having a highly-durable three-layer structure in which a photoreceptor surface-protecting layer is provided on the top layer.

The charge generating layer contains as a main ingredient a charge generating substance that generates charges under irradiation of light, and optionally contains known binder resin, plasticizer, sensitizer, etc. As the charge generating substance, materials used customarily in the relevant field can be used including, for example: perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing at least fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more thereof may be used in combination. The content of the charge generating substance is not particularly limited, and preferably falls within a range of from 5 parts by weight to 500 parts by weight, more preferably from 10 parts by weight to 200 parts by weight based on 100 parts by weight of the binder resin in the charge generating layer. Also as the binder resin for charge generating layer, materials used customarily in the relevant field may be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resins may be used each alone or, optionally, two or more thereof may be used in combination.

The charge generating layer can be formed by dissolving or dispersing appropriate amounts of a charge generating substance, binder resin and, optionally, a plasticizer, a sensitizer, etc. in an appropriate organic solvent which is capable of dissolving or dispersing the ingredients described above, to thereby prepare a coating solution for charge generating layer, and then applying the coating solution for charge generating layer to the surface of the conductive substrate, followed by drying. The thickness of the charge generating layer obtained in this way is not particularly limited, and preferably falls within a range of from 0.05 μm to 5 μm, more preferably from 0.1 μm to 2.5 μm.

The charge transporting layer stacked over the charge generating layer contains as essential ingredients a charge transporting substance having an ability of receiving and transporting charges generated from the charge generating substance, and a binder resin for charge transporting layer, and optionally contains known antioxidant, plasticizer, sensitizer, lubricant, etc. As the charge transporting substance, materials used customarily in the relevant field may be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl) propane, styrylanthracene, styrylpyrazoline, a pyrazoline derivative, phenyl hydrazones, a hydrazone derivative, a triphenylamine-based compound, a tetraphenyldiamine-based compound, a triphenylmethane-based compound, a stilbene-based compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone. The charge transporting substances may be used each alone, or two or more thereof may be used in combination. The content of the charge transporting substance is not particularly limited, and preferably falls within a range of from 10 parts by weight to 300 parts by weight, more preferably from 30 parts by weight to 150 parts by weight based on 100 parts by weight of the binder resin in the charge transporting layer. As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resins may be used each alone, or two or more thereof may be used in combination.

The charge transporting layer preferably contains an antioxidant together with the charge transporting substance and the binder resin for charge transporting layer. Also for the antioxidant, materials used customarily in the relevant field may be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more thereof may be used in combination. The content of the antioxidant is not particularly limited, and falls within a range of 0.01% by weight to 10% by weight, preferably 0.05% by weight to 5% by weight of the total amount of the ingredients constituting the charge transporting layer. The charge transporting layer can be formed by dissolving or dispersing appropriate amounts of a charge transporting substance, a binder resin and, optionally, an antioxidant, a plasticizer, a sensitizer, etc. in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably falls within a range of 10 μm to 50 μm, more preferably 15 μm to 40 μm. Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

Although a photoreceptor drum used in the present embodiment has an organic photosensitive layer as described above containing the charge generating substance and the charge transporting substance, it is also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 when viewed in a longitudinal direction of the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum. It is also possible to use a contact-charging type charger such as a charging brush or a magnetic brush.

The exposure unit 13 is disposed so that light beams corresponding to each color information emitted from the exposure unit 13 passes between the charging section 12 and the developing section 14 and reaches the surface of the photoreceptor drum 11. In the exposure unit 13, the image information is converted into light beams corresponding to each color information of black (b), cyan (c), magenta (m), and yellow (y), and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED array and a unit in which a liquid-crystal shutter and a light source are appropriately combined with each other.

Figure 2:
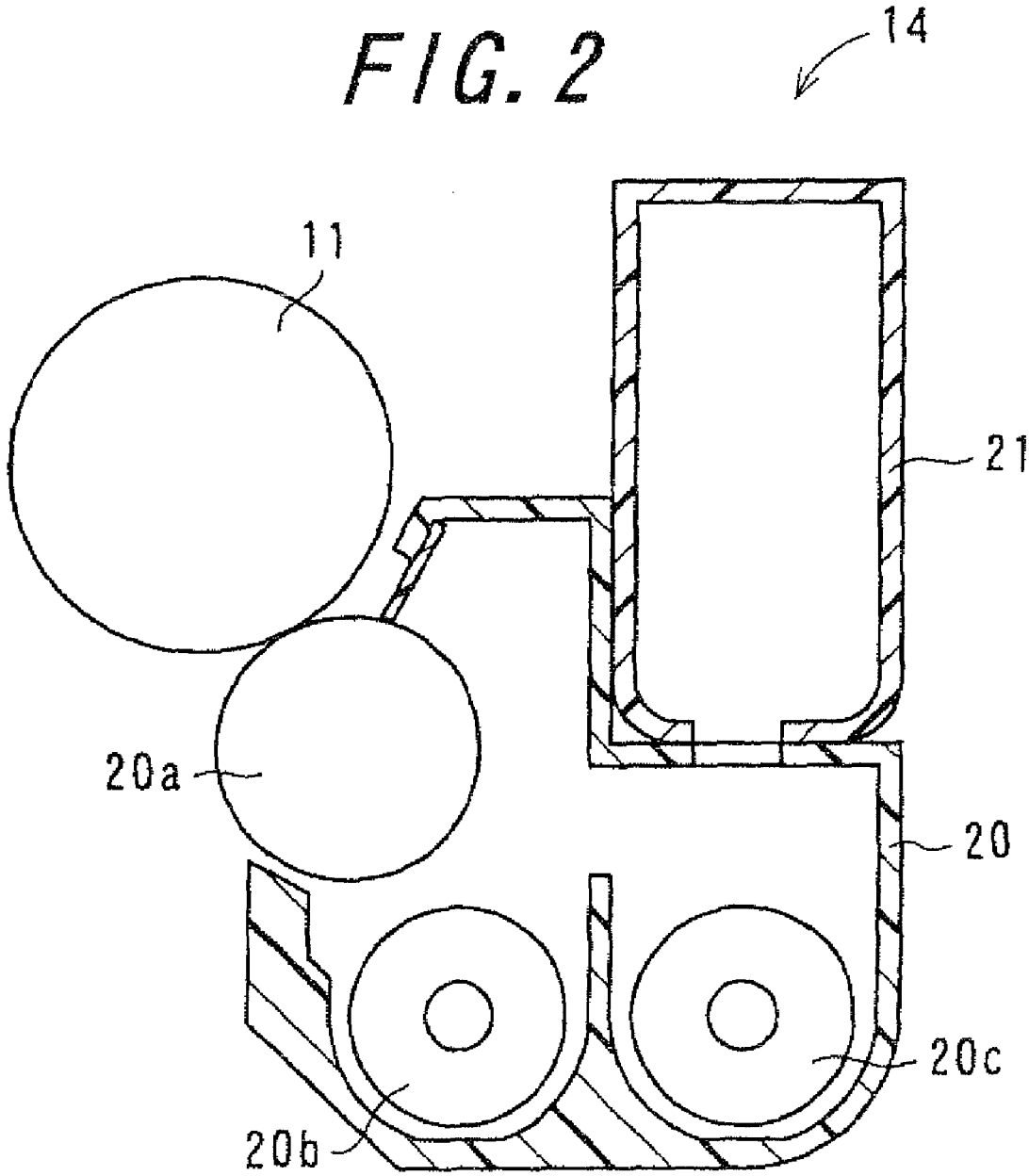
FIG. 2 is a sectional view schematically showing one example of a configuration of a developing device according to the embodiment of the invention.

FIG. 2 is a sectional view schematically showing one example of a configuration of the developing device 14 according to the embodiment of the invention. The developing device 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains in an internal space thereof the toner, and rotatably supports roller members such as a developing roller 20*a*, a supplying roller 20*b*, and an agitating roller 20*c*, or screw members, which roller or screw members are contained in the developing tank 20. The developing tank 20 has an opening in a side face thereof opposed to the photoreceptor drum 11. The developing roller 20*a* is rotatably provided at such a position as to face the photoreceptor drum 11 through the opening just stated. The developing roller 20*a* is a roller-shaped member for supplying a toner to the electrostatic latent image on the surface of the photoreceptor drum 11 in a pressure-contact portion or most-adjacent portion between the developing roller 20*a* and the photoreceptor drum 11. In supplying the toner, to a surface of the developing roller 20*a* is applied potential whose polarity is opposite to polarity of the potential of the charged toner, which serves as development bias voltage. By so doing, the toner on the surface of the developing roller 20*a* is smoothly supplied to the electrostatic latent image. Furthermore, an amount of the toner being supplied to the electrostatic latent image (which amount is referred to as "toner attachment amount") can be controlled by changing a value of the development bias voltage. The supplying roller 20*b* is a roller-shaped member which is rotatably disposed so as to face the developing roller 20*a* and used to supply the toner to the vicinity of the developing roller 20*a*. The agitating roller 20*c* is a roller-shaped member which is rotatably disposed so as to face the supplying roller 20*b* and used to feed to the vicinity of the supplying roller 20*b* the toner which is newly supplied from the toner hopper 21 into the developing tank 20. The toner hopper 21 is disposed so as to communicate a toner replenishment port (not shown) formed in a vertically lower part of the toner hopper 21, with a toner reception port (not shown) formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. In the image forming apparatus 1 of the embodiment, an organic photoreceptor drum is mainly used as the photoreceptor drum 11. A surface of the organic photoreceptor drum contains a resin component as a main ingredient and therefore tends to be degraded by chemical action of ozone which is generated by corona discharging of the charging section 12. The degraded surface part is, however, worn away by abrasion through the cleaning unit 15 and thus removed reliably, though gradually. Accordingly, the problem of the surface degradation caused by the ozone, etc. is actually solved, and it is thus possible to stably maintain the potential of charges given by the charging operation over a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of toner image forming operations just described are repeatedly carried out.

The transfer section 30 is disposed above the photoreceptor drum 11 and includes the intermediate transfer belt 25, a driving roller 26, a driven roller 27, an intermediate transfer roller 28*b*, 28*c*, 28*m*, 28*y*, a transfer belt cleaning unit 29, and a transfer roller 30. The intermediate transfer belt 25 is an endless belt stretched between the driving roller 26 and the driven roller 27, thereby forming a loop-shaped travel path. The intermediate transfer belt 25 rotates in an arrow B direction, that is, a direction in which a surface of intermediate transfer belt 28 in contact with the photoreceptor drum 11 moves from the photoreceptor drum 11*y* to the photoreceptor drum 11*b*.

When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transfer roller 28 which is disposed opposite to the photoreceptor drum 11 across the intermediate transfer belt 25, with the result that the toner image formed on the surface of the photoreceptor drum 11 is transferred onto the intermediate transfer belt 25. In the case of a multicolor image, the toner images of respective colors formed on the respective photoreceptor drums 11 are sequentially transferred and overlaid onto the intermediate transfer belt 25, thus forming a multicolor toner image. The driving roller 26 can rotate around an axis thereof with the aid of a drive portion (not shown), and the rotation of the driving roller 26 drives the intermediate transfer belt 25 to rotate in the arrow B direction. The driven roller 27 can be driven to rotate by the rotation of the driving roller 26, and imparts constant tension to the intermediate transfer belt 25 so that the intermediate transfer belt 25 does not go slack. The intermediate transferring roller 28 is disposed in pressure-contact with the photoreceptor drum 11 across the intermediate transfer belt 25, and capable of rotating around its own axis by a drive portion (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25. The transfer belt cleaning unit 29 is disposed opposite to the driven roller 27 across the intermediate transfer belt 25 so as to come into contact with an outer circumferential surface of the intermediate transfer belt 25. The toner is attached to the intermediate transfer belt 25 when the intermediate transfer belt 25 contacts the photoreceptor drum 11, and the toner may cause contamination on a reverse side of the recording medium. The transfer belt cleaning unit 29 therefore removes and collects the toner on the surface of the intermediate transfer belt 25. The transfer roller 30 is disposed in pressure-contact with the driving roller 26 across the intermediate transfer belt 25, and capable of rotating around its own axis by a drive portion (not shown). In a pressure-contact portion (a transfer nip portion) between the transfer roller 30 and the driving roller 26, a toner image which has been carried by the intermediate transfer belt 25 and thereby conveyed to the pressure-contact portion is transferred onto a recording medium fed from the later-described recording medium feeding section 5. The recording medium carrying the toner image is fed to the fixing section 4. In the transfer section 3, the toner image is transferred from the photoreceptor drum 11 onto the intermediate transfer belt 25 in the pressure-contact portion between the photoreceptor drum 11 and the intermediate transfer roller 28, and by the intermediate transfer belt 25 rotating in the arrow B direction, the transferred toner image is conveyed to the transfer nip portion where the toner image is transferred onto the recording medium.

The fixing section 4 is provided downstream of the transfer section 3 along a conveyance direction of the recording medium, and contains a fixing roller 31 and a pressure roller 32. The fixing roller 31 can rotate by a drive portion (not shown), and heats the toner constituting an unfixed toner image carried on the recording medium so that the toner is molten to be fixed on the recording medium. Inside the fixing roller 31 is provided a heating portion (not shown). The heating portion heats the heating roller 31 so that a surface of the heating roller 31 has a predetermined temperature (heating temperature). For the heating portion, a heater, a halogen lamp, and the like device may be used, for example. The heating portion is controlled by the later-described fixing condition control portion. In the vicinity of the surface of the fixing roller 31 is provided a temperature detecting sensor which detects a surface temperature of the fixing roller 31. A result detected by the temperature detecting sensor is written to a memory portion of the later-described control unit. The pressure roller 32 is disposed in pressure-contact with the fixing roller 31, and supported so as to be rotatably driven by the drive rotation of the fixing roller 31. The pressure roller 32 helps the toner image to be fixed onto the recording medium by pressing the toner and the recording medium when the toner is molten to be fixed onto the recording medium by the fixing roller 31. A pressure-contact portion between the fixing roller 31 and the pressure roller 32 is a fixing nip portion. In the fixing section 4, the recording medium onto which the toner image has been transferred in the transfer section 3 is nipped by the fixing roller 31 and the pressure roller 32 so that when the recording medium passes through the fixing nip portion, the toner image is pressed and thereby fixed onto the recording medium under heat, whereby a toner image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus 1 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path S1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip portion the recording medium fed from the conveying rollers 37 in synchronization with the conveyance of the toner image carried on the intermediate transfer belt 25 to the transfer nip portion. The manual paper feed tray 39 is a device storing recording mediums which are different from the recording mediums stored in the automatic paper feed tray 35 and may have any size and which are to be taken into the image forming apparatus 1. The recording medium taken in from the manual paper feed tray 39 passes through a paper conveyance path S2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip portion in synchronization with the conveyance of the toner image carried on the intermediate transfer belt 25 to the transfer nip portion.

The discharging section 6 includes the conveying rollers 37, discharging rollers 40, and a catch tray 41. The conveying rollers 37 are disposed downstream of the fixing nip portion along the paper conveyance direction, and conveys toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 1. The catch tray 41 stores the recording medium onto which the image has been fixed.

The image forming apparatus 1 includes a control unit (not shown). The control unit is disposed, for example, in an upper part of an internal space of the image forming apparatus 1, and contains a memory portion, a computing portion, and a control portion. To the memory portion of the control unit are inputted, for example, various set values obtained by way of an operation panel (not shown) disposed on the upper surface of the image forming apparatus 1, results detected from a sensor (not shown) etc. disposed in various portions inside the image forming apparatus 1, and image information obtained from an external equipment. Further, programs for operating various functional elements are written to the memory portion. Examples of the various functional elements include a recording medium determining portion, an attachment amount control portion, and a fixing condition control portion. For the memory portion, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus 1. Examples of the external equipment include a computer, a digital camera, a television, a video recorder, a DVD (digital versatile disc) recorder, an HDDVD (high-definition digital versatile disc), a blu-ray disc recorder, a facsimile machine, and a mobile computer. The computing portion of the control unit takes out the various data (such as an image formation order, the detected result, and the image information) written to the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit (CPU). The control unit contains a main power source as well as the above-stated processing circuit. The power source supplies electricity to not only the control unit but also respective devices provided inside the image forming apparatus 1.

The developing device 14 according to the embodiment uses the toner according to the embodiment or the two-component developer according to the embodiment as described above, and therefore is capable of forming over a long period of time toner images not causing fogs or uneven image density on the photoreceptor drum 11 serving as an image bearing member.

And the image forming apparatus 1 according to the embodiment has the developing device 14 according to the embodiment, and therefore is capable of forming over a long period of time high-quality images which exhibit excellent color reproducibility without fogs and uneven image density.

EXAMPLES

Hereinafter, the invention will be specifically explained with reference to Examples and Comparative examples to which the invention is not particularly limited within its scope. Note that in the following description, "particles of mixed oxide of aluminum oxide and silicon dioxide" will be simply referred to as "$Al_2O_3$—$SiO_2$".

[Method of Measuring Values of Properties]

Values of properties in Examples and Comparative examples are measured as follows.

<Weight Average Molecular Weight (Mw) and Number Average Molecular Weight (Mn)>

A molecular weight distribution curve was obtained in a manner that at a temperature of 40° C., 200 μL of a sample solution, or a 0.25-wt % tetrahydrofuran (hereinafter abbreviated as "THF") solution, was injected to a GPC system:

HLC-8220GPC (trade name) manufactured by TOSOH Corporation. On the basis of the molecular weight distribution curve thus obtained, the weight average molecular weight (Mw) and the number average molecular weight (Mn) were determined. Note that the molecular weight calibration curve was created by using standard polystyrene.

<Softening Temperature ($T_{1/2}$)>

Using a device for evaluating flow characteristics: FLOWTESTER CFT-500C (trade name) manufactured by Shimadzu Corporation, 1 g of a sample inserted into a cylinder was heated at a temperature of which increase rate was 6° C./min, under load of 10 kgf/cm$^2$ (0.98 MPa) so as to be pushed out of a die, and a temperature of the sample at the time when a half of the sample had flowed out of the die, was determined as the softening temperature ($T_{1/2}$). The die used had an aperture of 1 mm and a length of 1 mm.

<Acid Value>

The acid value of a sample was measured as follows in accordance with a neutralization titration method. A sample in an amount of 5 g was dissolved in 50 mL of THF, to which was then added several drops of an ethanol solution of phenolphthalein as an indicator, and the resultant sample was subjected to titration with a 0.1 mol/L aqueous solution of potassium hydroxide (KOH). The point at which the sample solution underwent a change in color from colorless to magenta was defined as endpoint, and the acid value (mgKOH/g) of the sample was calculated from the amount of the aqueous solution of potassium hydroxide taken to reach the endpoint and the amount of sample used for the titration.

<Compositional Proportion of $Al_2O_3$>

The compositional proportion of $Al_2O_3$ was calculated from a value of characteristic X-ray intensity measured by an X-ray fluorescence spectrometer: ZSX PRIMUS II (trade name) manufactured by Rigaku Corporation. The measurement was made where: a target of X-ray source was Rh; a voltage applied to the X-ray source was 40 kV; a current value was 50 mA; an optical dispersive crystal was LiF (for $Al_2O_3$ particles); a scintillation counter and a photon counter were used as detectors; the skip scan method was employed in scanning of the spectrometer; and an angle was set at 0.05 degree per step.

<Average Primary Particle Size>

A particle image was taken at a magnification of 50,000 by a scanning electron microscope: S-4300SE/N (trade name) manufactured by Hitachi High-Technologies Corporation, of which field was then adjusted so that 100 particles were photographed. The photo image thus obtained was then analyzed to measure particle sizes of the primary particles. From the measurement values thus obtained, the average primary particle size was determined.

<Volume Average Particle Size>

To 50 ml of an electrolytic solution: ISOTON-II (trade name) manufactured by Beckman Coulter, Inc., 20 mg of a sample and 1 ml of sodium alkyl ether sulfate were added. The resultant mixture was subjected to 3 minutes' dispersion processing at an ultrasonic frequency of 20 kHz by means of an ultrasonic dispersing machine: UH-50 (trade name) manufactured by SMT Co., Ltd. Thus, a measuring sample was prepared. And volume particle-size distribution of the measuring sample was determined by using particle-size distribution measuring equipment: MULTISIZER III (trade name) manufactured by Beckman Coulter, Inc. under conditions that the aperture diameter was 100 μm and the number of measured particles was 50,000 counts. From the measurement result, the volume average particle size $D_{50}$ (μm) was determined.

[Toner Production]

The toner was produced by adding the external additive to the toner base particles which contains the colorant, the charge control agent, the release agent, as well as the binder resin containing the crystalline polyester and the amorphous resin.

<Production of Polylactic Acid Copolymer (Crystalline Polyester: CE-1)>

A polymerization reactor was charged with 3 kg of L-lactide, 2 kg of DL-lactide, and 1.2 g of tin octylate which were then heated to effect ring-opening polymerization in a nitrogen atmosphere for one hour at 195° C. and subsequently were polymerized for two more hours at 190° C. with 100 g of 1,3-propanediol and 50 g of terephthalic acid newly added, resulting in a polylactic acid copolymer (CE-1) that had a weight average molecular weight (Mw) of 10,500, a number average molecular weight (Mn) of 3,900, a softening temperature ($T_{1/2}$) of 135° C., and an acid value of 8.8 mgKOH/g.

<Production of Amorphous Polyester (Amorphous Resins: P-1 to P-5)>

Monomers of bisphenol A propyrene oxide, terephthalic acid, and trimellitic acid anhydride were polycondensed to result in the amorphous polyesters (P-1 to P-5) having different acid values.

<Production of $Al_2O_3$—$SiO_2$ (A-1 to A-9)>

In accordance with the heretofore known burner arrangement disclosed in Example 1 of EP 0 585 544, 1.4 Nm$^3$/h of core hydrogen (Kenwasserstoff) or reaction hydrogen (Reaktionswasserstoff) was mixed at around 200° C. with 5.5 Nm$^3$/h of air and 1.30 kg/h of $SiCl_4$ evaporated in advance. To this heated mixture at around 200° C., 0.90 kg/h of gaseous $AlCl_3$ evaporated at 300° C. in advance was supplied. The resultant mixture was combusted in a flame tube to which 12 Nm$^3$/h of air was supplied during the combustion. After having passed through the flame tube, produced powers were separated from the gases containing hydrochloric acid in a filter or by cyclones. Adhering residues of hydrochloric acid were separated from the produced mixed oxide by a high-temperature treatment, and $Al_2O_3$—$SiO_2$ (A-1) was produced. By changing a proportion of $SiCl_4$ to $AlCl_4$ to be supplied in the above-described method, $Al_2O_3$—$SiO_2$ (A-1 to A-9) were produced which had different compositional proportions of $Al_2O_3$ or different average primary particle sizes.

Example 1

Production of Toner Base Particles

By a Henschel mixer: FM20C (trade name) manufactured by Mitsui Mining Co., Ltd., the following toner ingredients were uniformly mixed: 100 parts by weight of the binder resin containing 40% by weight of the polylactic acid copolymer (CE-1) and 60% by weight of the amorphous polyester (P-1) having an acid value of 15 mgKOH/g); 5.0 parts by weight of copper phthalocyanine (C.I. pigment blue 15 acting as a colorant, made by Clariant Corporation); 2.0 parts by weight of a zinc salicylic acid compound: BONTRON E-84 (trade name) made by Orient Chemical Industries, Ltd.; and 4.5 parts by weight of paraffin wax (acting as a release agent, trade name: HNP10, made by Nippon Seiro Co., Ltd.). And then, an admixture thus obtained was melt-kneaded on heating by a twin-screw extruder: PCM-65 (trade name) manufactured by Ikegai, Ltd., and thereafter cooled to room temperature. A solidified product of melt-kneaded materials was thus prepared.

The obtained melt-kneaded materials were coarsely pulverized by means of a cutter mill: VM-16 (trade name) manufactured by Orient Kabushiki Kaisha, and then finely pulverized by means of a counter jet mill: COUNTER JET MILL (trade name) manufactured by Hosokawa Micron Corporation, followed by classification in a rotary classifier: TSP SEPARATOR (trade name) manufactured by Hosokawa Micron Corporation, which had the setting of removing fine particles. The toner base particles were thus produced and its volume average particle size was 6.2 μm.

(Production of Toner)

To 100 parts by weight of the toner base particles obtained as above, added were 1.5 parts by weight of $Al_2O_3$—$SiO_2$ (A-1) having an $Al_2O_3$ compositional proportion of 40% by weight and an average particle size of 20 nm; and 2.0 parts by weight of hydrophobic silica: RX-50 (trade name) made by Nippon Aerosil Co., Ltd., and these ingredients were mixed by a Henschel mixer: FM MIXER (trade name) manufactured by Mitsui Mining Co., Ltd. The toner of Example 1 was thus produced.

Example 2

A toner of Example 2 was obtained in the same manner as Example 1 except that a resin containing 21% by weight of the polylactic acid copolymer (CE-1) and 79% by weight of the amorphous polyester (P-1) was used. The toner base particles obtained had a volume average particle size of 6.2 μm.

Example 3

A toner of Example 3 was obtained in the same manner as Example 1 except that a resin containing 49% by weight of the polylactic acid copolymer (CE-1) and 51% by weight of the amorphous polyester (P-1) was used. The toner base particles obtained had a volume average particle size of 6.2 μm.

Example 4

A toner of Example 4 was obtained in the same manner as Example 1 except that $Al_2O_3$—$SiO_2$ (A-2) was added which had an $Al_2O_3$ compositional proportion of 36% by weight and an average primary particle size of 20 nm, instead of $Al_2O_3$—$SiO_2$ (A-1). The toner base particles obtained had a volume average particle size of 6.2 μm.

Example 5

A toner of Example 5 was obtained in the same manner as Example 1 except that $Al_2O_3$—$SiO_2$ (A-3) was added which had an $Al_2O_3$ compositional proportion of 49% by weight and an average primary particle size of 20 nm, instead of $Al_2O_3$—$SiO_2$ (A-1). The toner base particles obtained had a volume average particle size of 6.2 μm.

Example 6

A toner of Example 6 was obtained in the same manner as Example 1 except that the resin used contained the amorphous polyester (P-2) having an acid value of 6 mgKOH/g, instead of the amorphous polyester (P-1).

Example 7

A toner of Example 7 was obtained in the same manner as Example 1 except that the resin used contained the amorphous polyester (P-3) having an acid value of 4 mgKOH/g, instead of the amorphous polyester (P-1).

Example 8

A toner of Example 8 was obtained in the same manner as Example 1 except that the resin used contained the amorphous polyester (P-4) having an acid value of 19 mgKOH/g, instead of the amorphous polyester (P-1).

Example 9

A toner of Example 9 was obtained in the same manner as Example 1 except that the resin used contained the amorphous polyester (P-5) having an acid value of 21 mgKOH/g, instead of the amorphous polyester (P-1).

Example 10

A toner of Example 10 was obtained in the same manner as Example 1 except that $Al_2O_3$—$SiO_2$ (A-4) was added which had a compositional proportion of $Al_2O_3$ of 40% by weight and an average primary particle size of 6 nm, instead of $Al_2O_3$—$SiO_2$ (A-1). The toner base particles obtained had a volume average particle size of 6.2 μm.

Example 11

A toner of Example 11 was obtained in the same manner as Example 1 except that $Al_2O_3$—$SiO_2$ (A-5) was added which had an $Al_2O_3$ compositional proportion of 40% by weight and an average primary particle size of 4 nm, instead of $Al_2O_3$—$SiO_2$ (A-1). The toner base particles obtained had a volume average particle size of 6.2 μm.

Example 12

A toner of Example 12 was obtained in the same manner as Example 1 except that $Al_2O_3$—$SiO_2$ (A-6) was added which had an $Al_2O_3$ compositional proportion of 40% by weight and an average primary particle size of 25 nm, instead of $Al_2O_3$—$SiO_2$ (A-1). The toner base particles obtained had a volume average particle size of 6.2 μm.

Example 13

A toner of Example 13 was obtained in the same manner as Example 1 except that $Al_2O_3$—$SiO_2$ (A-7) was added which had an $Al_2O_3$ compositional proportion of 40% by weight and an average primary particle size of 27 nm, instead of $Al_2O_3$—$SiO_2$ (A-1). The toner base particles obtained had a volume average particle size of 6.2 μm.

Example 14

A toner of Example 14 was obtained in the same manner as Example 1 except that 0.1 part by weight of $Al_2O_3$—$SiO_2$ (A-1) was added. The toner base particles obtained had a volume average particle size of 6.2 μm.

Example 15

A toner of Example 15 was obtained in the same manner as Example 1 except that 0.08 part by weight of $Al_2O_3$—$SiO_2$ (A-1) was added. The toner base particles obtained had a volume average particle size of 6.2 μm.

Example 16

A toner of Example 16 was obtained in the same manner as Example 1 except that 5.0 parts by weight of $Al_2O_3$—$SiO_2$ (A-1) was added. The toner base particles obtained had a volume average particle size of 6.2 μm.

Example 17

A toner of Example 17 was obtained in the same manner as Example 1 except that 5.2 parts by weight of $Al_2O_3$—$SiO_2$ (A-1) was added. The toner base particles obtained had a volume average particle size of 6.2 μm.

Example 18

A toner of Example 18 was obtained in the same manner as Example 1 except that conditions for pulverization and for classification are modified. The toner base particles obtained had a volume average particle size of 4.0 μm.

Example 19

A toner of Example 19 was obtained in the same manner as Example 1 except that conditions for pulverization and for classification are modified. The toner base particles obtained had a volume average particle size of 8.0 μm.

Example 20

A toner of Example 20 was obtained in the same manner as Example 1 except that conditions for pulverization and for classification are modified. The toner base particles obtained had a volume average particle size of 3.5 μm.

Example 21

A toner of Example 21 was obtained in the same manner as Example 1 except that conditions for pulverization and for classification are modified. The toner base particles obtained had a volume average particle size of 9.0 μm.

Comparative Example 1

A toner of Comparative example 1 was obtained in the same manner as Example 1 except that titanium oxide ($TiO_2$): T-805 (trade name) made by Nippon Aerosil Co., Ltd. was added, instead of $Al_2O_3$—$SiO_2$ (A-1). The toner base particles obtained had a volume average particle size of 6.2 μm.

Comparative Example 2

A toner of Comparative example 2 was obtained in the same manner as Example 1 except that the resin used contained 19% by weight of the polylactic acid copolymer (CE-1) and 81% by weight of the amorphous polyester (P-1). The toner base particles obtained had a volume average particle size of 6.2 μm.

Comparative Example 3

A toner of Comparative example 3 was obtained in the same manner as Example 1 except that the resin used contained 52% by weight of the polylactic acid copolymer (CE-1) and 48% by weight of the amorphous polyester (P-1). The toner base particles obtained had a volume average particle size of 6.2 μm.

Comparative Example 4

A toner of Comparative example 4 was obtained in the same manner as Example 1 except that $Al_2O_3$—$SiO_2$ (A-8) was added which had an $Al_2O_3$ compositional proportion of 34% by weight and an average primary particle size of 20 nm, instead of $Al_2O_3$—$SiO_2$ (A-1). The toner base particles obtained had a volume average particle size of 6.2 μm.

Comparative Example 5

A toner of Comparative example 5 was obtained in the same manner as Example 1 except that $Al_2O_3$—$SiO_2$ (A-9) was added which had an $Al_2O_3$ compositional proportion of 51% by weight and an average primary particle size of 20 nm, instead of $Al_2O_3$—$SiO_2$ (A-1). The toner base particles obtained had a volume average particle size of 6.2 μm.

Table 1 shows a content of the polylactic acid copolymer (CE-1) as well as a kind and an acid value of the amorphous resin, which are contained in the binder resin; a volume average particle size $D_{50v}$ of the toner base particles; and a kind, an $Al_2O_3$ compositional proportion, an average primary particle size, and an additive amount, of the external additive other than hydrophobic silica.

TABLE 1

| | Binder resin | | | Toner base | External additive (exc. hydrophobic silica) | | | |
|---|---|---|---|---|---|---|---|---|
| | CE-1 | Amorphous resin | | particles | | $Al_2O_3$ compositional | Average primary | Additive |
| | Content (wt %) | Kind | Acid value (mgKOH/g) | $D_{50v}$ (μm) | Kind | proportion (wt %) | particle size (nm) | amount (wt part) |
| Ex. 1 | 40 | P-1 | 15 | 6.2 | A-1 | 40 | 20 | 1.5 |
| Ex. 2 | 21 | P-1 | 15 | 6.2 | A-1 | 40 | 20 | 1.5 |
| Ex. 3 | 49 | P-1 | 15 | 6.2 | A-1 | 40 | 20 | 1.5 |
| Ex. 4 | 40 | P-1 | 15 | 6.2 | A-2 | 36 | 20 | 1.5 |
| Ex. 5 | 40 | P-1 | 15 | 6.2 | A-3 | 49 | 20 | 1.5 |
| Ex. 6 | 40 | P-2 | 6 | 6.2 | A-1 | 40 | 20 | 1.5 |
| Ex. 7 | 40 | P-3 | 4 | 6.2 | A-1 | 40 | 20 | 1.5 |
| Ex. 8 | 40 | P-4 | 19 | 6.2 | A-1 | 40 | 20 | 1.5 |
| Ex. 9 | 40 | P-5 | 21 | 6.2 | A-1 | 40 | 20 | 1.5 |
| Ex. 10 | 40 | P-1 | 15 | 6.2 | A-4 | 40 | 6 | 1.5 |
| Ex. 11 | 40 | P-1 | 15 | 6.2 | A-5 | 40 | 4 | 1.5 |
| Ex. 12 | 40 | P-1 | 15 | 6.2 | A-6 | 40 | 25 | 1.5 |
| Ex. 13 | 40 | P-1 | 15 | 6.2 | A-7 | 40 | 27 | 1.5 |

TABLE 1-continued

| | Binder resin | | | Toner base | External additive (exc. hydrophobic silica) | | | |
|---|---|---|---|---|---|---|---|---|
| | CE-1 | Amorphous resin | | particles | | $Al_2O_3$ compositional | Average primary | Additive |
| | Content (wt %) | Kind | Acid value (mgKOH/g) | $D_{50v}$ (μm) | Kind | proportion (wt %) | particle size (nm) | amount (wt part) |
| Ex. 14 | 40 | P-1 | 15 | 6.2 | A-1 | 40 | 20 | 0.1 |
| Ex. 15 | 40 | P-1 | 15 | 6.2 | A-1 | 40 | 20 | 0.08 |
| Ex. 16 | 40 | P-1 | 15 | 6.2 | A-1 | 40 | 20 | 5.0 |
| Ex. 17 | 40 | P-1 | 15 | 6.2 | A-1 | 40 | 20 | 5.2 |
| Ex. 18 | 40 | P-1 | 15 | 4.0 | A-1 | 40 | 20 | 1.5 |
| Ex. 19 | 40 | P-1 | 15 | 8.0 | A-1 | 40 | 20 | 1.5 |
| Ex. 20 | 40 | P-1 | 15 | 3.5 | A-1 | 40 | 20 | 1.5 |
| Ex. 21 | 40 | P-1 | 15 | 9.0 | A-1 | 40 | 20 | 1.5 |
| Com. Ex. 1 | 40 | P-1 | 15 | 6.2 | $TiO_2$ | — | 20 | 1.5 |
| Com. Ex. 2 | 19 | P-1 | 15 | 6.2 | A-1 | 40 | 20 | 1.5 |
| Com. Ex. 3 | 52 | P-1 | 15 | 6.2 | A-1 | 40 | 20 | 1.5 |
| Com. Ex. 4 | 40 | P-1 | 15 | 6.2 | A-8 | 34 | 20 | 1.5 |
| Com. Ex. 5 | 40 | P-1 | 15 | 6.2 | A-9 | 51 | 20 | 1.5 |

[Production of Two-Component Developer]

The above toner was mixed with a ferrite core carrier of which particles had a volume average particle size of 45 μm, for 20 minutes by means of a V-type mixer: V-5 (trade name) manufactured by Tokuju Corporation so that each of the toners of Examples 1 to 21 and Comparative examples 1 to 5 covers the carrier at coverage rate of 60%. The two-component developers were thus produced.

[Evaluation]

Of each toner of Examples 1 to 21 and Comparative examples 1 to 5, the transparency, fixing property, thin-line reproducibility, image density uniformity, background fogs, and charge amount were evaluated as follows. The evaluation results and comprehensive evaluation are shown in Table 2. Note that in Table 2, the initial evaluation represents later-described evaluation conducted after completion of filling an empty toner cartridge with a toner, and the post-print evaluation represents later-described evaluation conducted after printing images on 10,000 sheets in the evaluation machine mentioned below. And the notes such as "Excellent", "Good", "Not bad", and "Poor" stated in the descriptions about the evaluation items represent the evaluation results shown in Table 2. In detail, "Excellent" represents that the toner is very good, "Good" represents that the toner is good, "Not bad" represents that the toner is practicable, and "Poor" represents that it is hard to put the toner into practical use.

(Evaluation Machine)

For evaluation of the toners of the invention, a full color copier: MX-2700 (trade name) manufactured by Sharp Corporation was used as an evaluation machine.

<Transparency>

By the above evaluation machine, a solid image measuring 3 cm by 3 cm was printed on an OHP sheet with a toner whose amount attached thereto was adjusted to be 0.5 mg/cm$^2$. And transmittance of 470 nm light through a fixing toner layer of the obtained solid image was measured by a spectrophotometer: U-3300 (trade name) manufactured by Hitachi, Ltd. A rate of transmittance deterioration was then calculated with reference to transmittance of a fixing toner layer of solid image formed of a toner containing no external additives. Evaluation criteria are as follows.

Good: The rate of deterioration is less than 10%.

Not bad: The rate of deterioration is 10% or more and less than 20%.

Poor: The rate of deterioration is 20% or more.

<Fixing Property>

By the above evaluation machine, the solid image measuring 3 cm by 3 cm was transferred onto a transfer sheet with a toner whose amount attached thereto was adjusted to be 0.5 mg/cm$^2$, and a temperature of the fixing roller was increased from 120° C. up to 210° C. at intervals of 5° C. to thereby locate a non-offset range (i.e., a temperature range that neither cold offset nor hot offset occurs). Evaluation criteria are as follows. Note that the cold offset and the hot offset are defined herein as toner adhesion to the transfer sheet after one rotation of the fixing roller with a toner which adheres thereto as having failed to be fixed to the transfer sheet during the fixing process.

Good: The non-offset range is located at 60° C. or higher temperatures.

Poor: The non-offset range is located below 60° C.

<Thin-Line Reproducibility>

A document having an original image drawn in exact-100 μm-wide thin lines was copied by the above evaluation machine under a condition that a 5 mm-diameter halftone image having image density of 0.3 can be copied so as to have the image density remaining in 0.3 or higher and 0.5 or lower. The copy image thus obtained was used as a sample for measurement. A width of thin line formed in the sample for measurement was determined by an indicator, on the basis of a monitor image which was obtained by enlarging by 100-fold the sample for measurement using a particle analyzer: LUZEX450 (trade name) manufactured by Nireco Corporation). The image density refers to optical reflection density measured by a reflection densitometer: RD-918 (trade name) manufactured by Macbeth Corporation. The thin line has irregularities and widths of the thin lines are thus different from each other depending on measurement positions. Therefore an average value of line widths measured at plural measurement positions was calculated and determined to be a line width of the sample for measurement. A reproducibility value of the thin line was obtained by centupling a value which was calculated by dividing the line width of the sample for measurement by the line width 100 μm of the original image. The reproducibility value of the thin line closer to 100 represents better thin-line reproducibility and higher resolution. Evaluation criteria are as follows.

Good: The reproducibility value of the thin line is more than 100 and less than 115.

Not bad: The reproducibility value of the thin line is more than 115 and less than 125.

Poor: The reproducibility value of the thin line is more than 125.

<Image Density Uniformity>

A solid image measuring 3 cm by 3 cm was printed on a transfer sheet by the above evaluation machine. Of the solid image thus obtained, density was measured at three positions, i.e., at the center and at both ends, by the reflection densitometer: RD918 (trade name) manufactured by Macbeth Corporation. Out of the reflection density thus measured, the highest density and the lowest density were compared to each other, and a difference therebetween was defined as a density difference which was then used for evaluation of image density uniformity based on the following criteria.

Good: The density difference is 0.15 or less.

Not bad: The density difference is more than 0.15 and 0.25 or less.

Poor: The density difference is more than 0.25.

<Background Fog>

Reflection density of a white background of the transfer sheet was measured by the reflection densitometer: RD918 (trade name) manufactured by Macbeth Corporation before and after the image was printed on the transfer sheet by the above evaluation machine. A difference between the reflection density measured before printing and the reflection density measured after printing was then used to evaluate the background fogs based on the following criteria.

Good: The reflection density difference is 0.005 or less.

Not bad: The reflection density difference is more than 0.005 and 0.009 or less.

Poor: The density difference is more than 0.009.

<Charge Amount>

The charge amount of the toner was measured by a charge measurement system: MODEL 210HS-2 (trade name) manufactured by Trek, Inc.

<Comprehensive Evaluation>

Evaluation criteria for the comprehensive evaluation are as follows.

Excellent: Very favorable. No "Poor" and "Not bad" are given in the whole evaluation results.

Good: Favorable. No "Poor" and one or more "Not bad" are given in the whole evaluation results.

Poor: Defective. "Poor" is given at least one of the evaluation results.

TABLE 2

| | Transparency | | Fixing property | | Thin-line reproducibility | | | | Image density uniformity | |
|---|---|---|---|---|---|---|---|---|---|---|
| | Rate of deterioration (%) | Evaluation | Non-offset range (° C.) | Evaluation | Initial | | After printing | | Initial | |
| | | | | | Measurement | Evaluation | Measurement | Evaluation | Measurement | Evaluation |
| Ex. 1 | 7 | Good | 70 (140-210) | Good | 109 | Good | 111 | Good | 0.07 | Good |
| Ex. 2 | 5 | Good | 60 (160-220) | Good | 111 | Good | 110 | Good | 0.08 | Good |
| Ex. 3 | 18 | Not bad | 70 (130-200) | Good | 114 | Good | 114 | Good | 0.15 | Good |
| Ex. 4 | 8 | Good | 70 (140-210) | Good | 110 | Good | 111 | Good | 0.08 | Good |
| Ex. 5 | 7 | Good | 70 (140-210) | Good | 114 | Good | 115 | Good | 0.09 | Good |
| Ex. 6 | 6 | Good | 70 (140-210) | Good | 110 | Good | 113 | Good | 0.09 | Good |
| Ex. 7 | 9 | Good | 70 (140-210) | Good | 117 | Not bad | 124 | Not bad | 0.16 | Not bad |
| Ex. 8 | 8 | Good | 70 (140-210) | Good | 112 | Good | 111 | Good | 0.09 | Good |
| Ex. 9 | 7 | Good | 70 (140-210) | Good | 114 | Good | 116 | Not bad | 0.18 | Not bad |
| Ex. 10 | 7 | Good | 70 (140-210) | Good | 113 | Good | 114 | Good | 0.10 | Good |
| Ex. 11 | 8 | Good | 70 (140-210) | Good | 116 | Not bad | 121 | Not bad | 0.19 | Not bad |
| Ex. 12 | 7 | Good | 70 (140-210) | Good | 112 | Good | 110 | Good | 0.08 | Good |
| Ex. 13 | 9 | Good | 70 (140-210) | Good | 117 | Not bad | 119 | Not bad | 0.19 | Not bad |
| Ex. 14 | 4 | Good | 70 (140-210) | Good | 112 | Good | 111 | Good | 0.12 | Good |
| Ex. 15 | 3 | Good | 70 (140-210) | Good | 117 | Not bad | 122 | Not bad | 0.23 | Not bad |
| Ex. 16 | 10 | Not bad | 70 (140-210) | Good | 110 | Good | 109 | Good | 0.14 | Good |
| Ex. 17 | 15 | Not bad | 70 (140-210) | Good | 120 | Not bad | 124 | Not bad | 0.22 | Not bad |
| Ex. 18 | 9 | Good | 70 (140-210) | Good | 105 | Good | 104 | Good | 0.06 | Good |
| Ex. 19 | 7 | Good | 70 (140-210) | Good | 112 | Good | 113 | Good | 0.07 | Good |
| Ex. 20 | 7 | Good | 70 (140-210) | Good | 106 | Good | 103 | Good | 0.08 | Good |
| Ex. 21 | 7 | Good | 70 (140-210) | Good | 119 | Not bad | 118 | Not bad | 0.01 | Good |
| Com. ex. 1 | 25 | Poor | 70 (140-210) | Good | 120 | Not bad | 135 | Poor | 0.20 | Not bad |
| Com. ex. 2 | 4 | Good | 50 (170-220) | Poor | 107 | Good | 110 | Good | 0.08 | Good |
| Com. ex. 3 | 19 | Not bad | 70 (125-195) | Good | 127 | Poor | 130 | Poor | 0.25 | Not bad |
| Com. ex. 4 | 8 | Good | 70 (140-210) | Good | 113 | Good | 128 | Poor | 0.14 | Good |
| Com. ex. 5 | 8 | Good | 71 (140-211) | Good | 121 | Not bad | 135 | Poor | 0.20 | Not bad |

| | Image density uniformity | | Background fog | | | | Charge amount | | |
|---|---|---|---|---|---|---|---|---|---|
| | After printing | | Initial | | After printing | | Initial | After printing | |
| | Measurement | Evaluation | Measurement | Evaluation | Measurement | Evaluation | Measurement (−° C./g) | Measurement (−° C./g) | Comprehensive Evaluation |
| Ex. 1 | 0.09 | Good | 0.002 | Good | 0.002 | Good | 28 | 26 | Excellent |
| Ex. 2 | 0.10 | Good | 0.002 | Good | 0.004 | Good | 30 | 29 | Excellent |
| Ex. 3 | 0.14 | Good | 0.003 | Good | 0.003 | Good | 27 | 28 | Good |
| Ex. 4 | 0.12 | Good | 0.002 | Good | 0.002 | Good | 31 | 31 | Excellent |
| Ex. 5 | 0.13 | Good | 0.004 | Good | 0.005 | Good | 25 | 25 | Excellent |
| Ex. 6 | 0.13 | Good | 0.003 | Good | 0.003 | Good | 27 | 26 | Excellent |

TABLE 2-continued

| | | | | | | | | | |
|---|---|---|---|---|---|---|---|---|---|
| Ex. 7 | 0.15 | Good | 0.004 | Good | 0.008 | Not bad | 23 | 22 | Good |
| Ex. 8 | 0.09 | Good | 0.003 | Good | 0.002 | Good | 30 | 28 | Excellent |
| Ex. 9 | 0.22 | Not bad | 0.005 | Good | 0.007 | Not bad | 33 | 34 | Good |
| Ex. 10 | 0.11 | Good | 0.003 | Good | 0.002 | Good | 27 | 26 | Excellent |
| Ex. 11 | 0.20 | Not bad | 0.004 | Good | 0.008 | Not bad | 25 | 25 | Good |
| Ex. 12 | 0.07 | Good | 0.003 | Good | 0.003 | Good | 29 | 29 | Excellent |
| Ex. 13 | 0.21 | Not bad | 0.005 | Good | 0.007 | Not bad | 30 | 30 | Good |
| Ex. 14 | 0.11 | Good | 0.003 | Good | 0.004 | Good | 29 | 30 | Excellent |
| Ex. 15 | 0.24 | Not bad | 0.004 | Good | 0.008 | Not bad | 30 | 32 | Good |
| Ex. 16 | 0.13 | Good | 0.002 | Good | 0.003 | Good | 25 | 26 | Good |
| Ex. 17 | 0.23 | Not bad | 0.004 | Good | 0.006 | Not bad | 24 | 22 | Good |
| Ex. 18 | 0.07 | Good | 0.004 | Good | 0.003 | Good | 26 | 25 | Excellent |
| Ex. 19 | 0.05 | Good | 0.002 | Good | 0.002 | Good | 25 | 28 | Excellent |
| Ex. 20 | 0.07 | Good | 0.008 | Not bad | 0.009 | Not bad | 25 | 26 | Good |
| Ex. 21 | 0.11 | Good | 0.002 | Good | 0.002 | Good | 27 | 28 | Good |
| Com. ex. 1 | 0.40 | Poor | 0.007 | Not bad | 0.029 | Poor | 23 | 18 | Poor |
| Com. ex. 2 | 0.07 | Good | 0.003 | Good | 0.003 | Good | 29 | 30 | Poor |
| Com. ex. 3 | 0.29 | Poor | 0.011 | Poor | 0.011 | Poor | 24 | 21 | Poor |
| Com. ex. 4 | 0.21 | Not bad | 0.008 | Not bad | 0.008 | Not bad | 30 | 25 | Poor |
| Com. ex. 5 | 0.31 | Poor | 0.010 | Poor | 0.020 | Poor | 23 | 19 | Poor |

The results shown in Table 2 reveal that the toners of Examples 1 to 21 of the invention are excellent as follows, as compared to the toners of Comparative examples 1 to 5.

The toners of Examples 1 to 21 are each formed by externally adding $Al_2O_3$—$SiO_2$ (A-1 to A-9) to toner base particles which contain a colorant and a binder resin containing crystalline polyester, i.e., a polylactic acid copolymer (CE-1) and an amorphous resin, i.e., amorphous polyester (P-1 to P-5), and in each of the toners, the binder resin contains 20% by weight to 50% by weight of the polylactic acid copolymer (CE-1), and $Al_2O_3$—$SiO_2$ (A-1 to A-9) contains an $Al_2O_3$ compositional proportion of 35% by weight to 50% by weight. These toners therefore exhibit good transparency and fixing properties as well as good thin-line reproducibility, image density uniformity, background fogs, and charge amounts which are stable over a long period of time.

The toner of Comparative example 1, to which $TiO_2$ was externally added instead of $Al_2O_3$—$SiO_2$ (A-1 to A-9), therefore exhibited deteriorated transparency and moreover, its thin-line reproducibility, image density uniformity, background fogs, and charge amount deteriorated as the toner was used for a long time.

The toner of Comparative example 2, in which the polylactic acid copolymer (CE-1) contained in the binder resin was less than 20% by weight, therefore exhibited a deteriorated fixing property.

The toner of Comparative example 3, in which the polylactic acid copolymer (CE-1) contained in the binder resin exceeded 50% by weight, therefore exhibited deteriorated thin-line reproducibility and image density uniformity, and generated background fogs.

The toner of Comparative example 4, in which an $Al_2O_3$ compositional proportion in $Al_2O_3$—$SiO_2$ (A-1 to A-9) was less than 35% by weight, therefore exhibited thin-line reproducibility and image density uniformity deteriorating as the toner was used for a long time.

The toner of Comparative example 5, in which an $Al_2O_3$ compositional proportion in $Al_2O_3$—$SiO_2$ (A-1 to A-9) exceeded 50% by weight, therefore exhibited deteriorated thin-line reproducibility and image density uniformity, and generated background fogs. And what is worse, the thin-line reproducibility and image density uniformity deteriorated as the toner was used for a long time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner comprising:

toner base particles containing a colorant and a binder resin containing at least crystalline polyester and an amorphous resin; and a mixed oxide of aluminum oxide and silicon dioxide externally added to the toner base particles, wherein a content of the crystalline polyester in the binder resin falls within a range of 20% by weight to 50% by weight, wherein a compositional proportion of aluminum oxide in the mixed oxide of aluminum oxide and silicon dioxide falls within a range of 35% by weight or more and less than 50% by weight, and wherein the crystalline polyester is a polylactic acid copolymer.

2. The toner of claim 1, wherein the amorphous resin has an acid value of 5 mgKOH/g to 20 mgKOH/g.

3. The toner of claim 1, wherein the mixed oxide of aluminum oxide and silicon dioxide is composed of particles having an average primary particle size of 5 nm to 25 nm.

4. The toner of claim 1, wherein the mixed oxide of aluminum oxide and silicon dioxide is added in an amount of from 0.1 part by weight to 5.0 parts by weight based on 100 parts by weight of the toner base particles.

5. The toner of claim 4, wherein the mixed oxide of aluminum oxide and silicon dioxide is added in an amount of from 0.1 part by weight to 2.0 parts by weight based on 100 parts by weight of the toner base particles.

6. The toner of claim 1, wherein the toner base particles have a volume average particle size of 4.0 μm to 8.0 μm.

7. The toner of claim 1, wherein the colorant is an organic colorant.

8. A two-component developer containing the toner of claim 1 and a carrier.

* * * * *